US010344458B2

(12) United States Patent
Hijikata et al.

(10) Patent No.: US 10,344,458 B2
(45) **Date of Patent: *Jul. 9, 2019**

(54) HYDRAULIC DRIVE SYSTEM FOR WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/554,118

(22) PCT Filed: Jun. 1, 2016

(86) PCT No.: PCT/JP2016/066307

§ 371 (c)(1),
(2) Date: Aug. 28, 2017

(87) PCT Pub. No.: WO2016/199654

PCT Pub. Date: Dec. 15, 2016

(65) Prior Publication Data

US 2018/0066416 A1 Mar. 8, 2018

(30) Foreign Application Priority Data

Jun. 9, 2015 (JP) ..... 2015-117023

(51) Int. Cl.
*E02F 9/22* (2006.01)
*E02F 9/26* (2006.01)
(Continued)

(52) U.S. Cl.
CPC ..... *E02F 9/2203* (2013.01); *E02F 9/2217* (2013.01); *E02F 9/2285* (2013.01);
(Continued)

(58) Field of Classification Search
CPC ..... F15B 20/00; F15B 20/002; F15B 20/004; F15B 20/007; F15B 21/14; E02F 9/2203;
(Continued)

(56) References Cited

U.S. PATENT DOCUMENTS 9,926,950 B2 * 3/2018 Ooki ..... F15B 11/024
9,926,951 B2 * 3/2018 Ooki ..... E02F 9/123
(Continued)

FOREIGN PATENT DOCUMENTS

CN 102146692 A 8/2011
CN 202063490 U 12/2011
(Continued)

OTHER PUBLICATIONS

Chinese-language Office Action issued in counterpart Chinese Application No. 201680008906.5 dated Apr. 2, 2018 (five pages).
(Continued)

*Primary Examiner* — Atul Trivedi
(74) *Attorney, Agent, or Firm* — Crowell & Moring LLP

(57) ABSTRACT

A hydraulic drive system 100A for a work machine includes: a boom cylinder 4; an arm cylinder 8; a hydraulic pump device 51; a control valve 5; a regenerative device 61; a first operation device 41; a second operation device 42; a sensor device 71; and a controller 27. The sensor device 71 includes at least one of pressure sensors 23, 24, 25, and 26. The controller 27 includes an abnormality detection part 142 and a first control part. The abnormality detection part 142 determines whether or not the sensor device 71 is abnormal. If the sensor device 71 is abnormal, the first control part controls the regenerative device 61 such that the hydraulic
(Continued)

fluid returning from the boom cylinder 4 is not supplied to the arm cylinder 8 even if the values measured by the sensor device 71 satisfy regenerative conditions.

5 Claims, 13 Drawing Sheets

(51) Int. Cl.
*F15B 20/00* (2006.01)
*F15B 21/14* (2006.01)

(52) U.S. Cl.
CPC ..... *E02F 9/2292* (2013.01); *E02F 9/2296* (2013.01); *E02F 9/268* (2013.01); *F15B 20/00* (2013.01); *F15B 20/004* (2013.01); *F15B 21/14* (2013.01); *F15B 20/002* (2013.01); *F15B 20/007* (2013.01)

(58) Field of Classification Search
CPC ..... E02F 9/2217; E02F 9/2285; E02F 9/2292; E02F 9/2296; E02F 9/268
USPC ..... 701/50
See application file for complete search history.

(56) References Cited

U.S. PATENT DOCUMENTS

2011/0192155 A1 8/2011 Hagiwara et al.
2013/0227936 A1* 9/2013 Takahashi ..... E02F 9/2235 60/297
2013/0317710 A1 11/2013 Sakurai et al.
2014/0165543 A1* 6/2014 Takebayashi ..... F02D 29/04 60/311
2014/0260233 A1* 9/2014 Giovanardi ..... F15B 13/0444 60/431
2014/0290237 A1* 10/2014 Yoshida ..... F02D 41/029 60/452
2015/0059568 A1* 3/2015 Williamson ..... F15B 11/024 91/415
2016/0123354 A1* 5/2016 Morita ..... E02F 9/2217 60/327
2016/0312442 A1* 10/2016 Egawa ..... E02F 9/2075
2017/0130744 A1* 5/2017 Zhang ..... F15B 11/024
2017/0234334 A1* 8/2017 Hijikata ..... E02F 9/22 60/484
2017/0276155 A1* 9/2017 Hijikata ..... E02F 9/22
2018/0051720 A1* 2/2018 Hijikata ..... E02F 9/2217
2018/0066416 A1* 3/2018 Hijikata ..... F15B 20/00
2018/0274208 A1* 9/2018 Hijikata ..... E02F 9/22
2018/0291935 A1* 10/2018 Kondo ..... F15B 21/14

FOREIGN PATENT DOCUMENTS

JP 6-1810 U 1/1994
JP 9-78635 A 3/1997
JP 11-280701 A 10/1999
JP 2002-89516 A 3/2002
JP 2010-190261 A 9/2010
JP 2012-215016 A 11/2012
JP 5296570 B2 9/2013

OTHER PUBLICATIONS

International Preliminary Report on Patentability (PCT/IB/338 & PCT/IB/373) issued in PCT Application No. PCT/JP2016/066307 dated Dec. 21, 2017, including English translation of document (Japanese-language Written Opinion (PCT/ISA/237)) previously filed Aug. 28, 2017 (Seven (7) pages).
International Search Report (PCT/ISA/210) issued in PCT Application No. PCT/JP2016/066307 dated Aug. 30, 2016 with English translation (six pages).
Japanese-language Written Opinion (PCT/ISA/237) issued in PCT Application No. PCT/JP2016/066307 dated Aug. 30, 2016 (four pages).
Korean-language Office Action issued in counterpart Korean Application No. 10-2017-7021669 dated Oct. 10, 2018 with English translation (11 pages).

* cited by examiner

HYDRAULIC DRIVE SYSTEM FOR WORK MACHINE

TECHNICAL FIELD

The present invention relates to hydraulic drive systems for work machines and particularly to a hydraulic drive system for a work machine such as a hydraulic excavator and other smaller work machine with hydraulic actuators, the system being capable of regenerating the hydraulic energy discharged from the hydraulic actuators.

BACKGROUND ART

A work machine is disclosed that regenerates the hydraulic fluid returning from a hydraulic actuator via a hydraulic valve for the purpose of saving energy (see Patent Document 1, for example).

PRIOR ART DOCUMENT

Patent Document

Patent Document 1: Japanese Patent No. 5296570

SUMMARY OF THE INVENTION

Problem to be Solved by the Invention

According to the technique disclosed in Patent Document 1, especially in a boom cylinder for driving a boom among several hydraulic actuators of the work machine, the power (hydraulic fluid) discharged from the bottom side of the boom cylinder when the boom falls under its own weight is regenerated via a valve to drive other actuators.

However, in a work machine such as the one disclosed in Patent Document 1, if any pressure sensor that detects hydraulic pressure goes out of order, the work device may operate in an expected manner.

For instance, Patent Document 1 describes a control such that, when the boom bottom pressure is higher than the arm rod pressure, with a boom lowering operation and an arm dumping operation being performed (ON) respectively, the regenerative valve is opened to perform regeneration, and the passage to the tank is throttled to reduce the bleed flow rate.

Assume a case where, at a certain moment, the boom bottom pressure is higher than the arm rod pressure, with an arm dumping operation being performed (ON) and no boom lowering operation being performed (OFF). In that case, if an abnormality occurs in the boom-lowering pilot pressure sensor and it is determined that a boom lowering operation is being performed, the controller determines that all the regenerative conditions are met and thus opens the regenerative valve. As a result, the hydraulic fluid of the boom bottom is regenerated to the arm rod, lowering the boom cylinder in an unexpected manner.

As another example, assume a case where the arm rod pressure is higher than the boom bottom pressure during a boom-lowering arm-dumping operation. In that case, since the arm rod pressure is higher than the boom bottom pressure, the regenerative valve is usually controlled to be kept closed. However, if it is determined that the boom bottom pressure is higher due to an abnormality of the boom bottom pressure sensor, the controller performs a control such as to open the regenerative valve and throttle the passage to the tank to reduce the bleed-off flow rate.

In this state, since the arm rod pressure is higher than the boom bottom pressure, the hydraulic fluid does not flow from the boom bottom to the arm rod even if the regenerative valve is opened. Moreover, since the passage to the tank is throttled, the hydraulic fluid discharged from the boom bottom has nowhere to go. As a result, the boom cylinder decelerates or stops suddenly, by which the operator may find strange in operability. The same phenomenon occurs when an abnormality occurs in the arm rod pressure sensor and it is determined that the arm rod pressure is lower than the boom bottom pressure even if the boom bottom pressure sensor is not defective. Such pressure sensor abnormalities are caused when a sensor has a wire disconnected or short-circuits.

The present invention has been made in view of the above matters, and an object of the invention is to provide a hydraulic drive system for a work machine that ensures that the operation of the hydraulic actuators matches the operator's operation even if an abnormality occurs in the sensor device.

Means for Solving the Problem

To achieve the above object, the invention is implemented to include as follows: a first hydraulic actuator; a second hydraulic actuator; a hydraulic pump device configured to supply hydraulic fluid to the first hydraulic actuator and the second hydraulic actuator; a control valve configured to adjust a flow rate of the hydraulic fluid returning from the first hydraulic actuator; a regenerative device configured to supply the hydraulic fluid returning from the first hydraulic actuator to the second hydraulic actuator; a first operation device configured to operate the first hydraulic actuator; a second operation device configured to operate the second hydraulic actuator; a sensor device including at least one of a first operation amount sensor configured to measure an operation amount of the first operation device, a second operation amount sensor configured to measure an operation amount of the second operation device, a first pressure sensor configured to measure a pressure of the bottom side of the first hydraulic actuator, and a second pressure sensor configured to measure a pressure between the hydraulic pump device and the second hydraulic actuator; and a controller including an abnormality detection part configured to determine whether the sensor device is abnormal or not and a first control part that controls the regenerative device such that the hydraulic fluid returning from the first hydraulic actuator is supplied to the second hydraulic actuator when the sensor device is normal and values measured by the sensor device satisfy regenerative conditions that are required to be met when the hydraulic fluid returning from the first hydraulic actuator is supplied to the second hydraulic actuator and such that, when the sensor device is abnormal, the hydraulic fluid returning from the first hydraulic actuator is not supplied to the second hydraulic actuator even if the values measured by the sensor device satisfy the regenerative conditions.

2. The hydraulic drive system for a work machine according to claim 1, wherein the controller further includes a second control part that controls the hydraulic pump device such that when the sensor device is normal and the values measured by the sensor device satisfy the regenerative conditions, the delivery flow rate of the hydraulic pump device is reduced on the basis of a regeneration flow rate at which the hydraulic fluid returning from the first hydraulic actuator is supplied to the second hydraulic actuator and, when the sensor device is abnormal, cancels the control for reducing the delivery flow rate of the hydraulic pump device even if the values measured by the sensor device satisfy the regenerative conditions.

With the above system, when the sensor device is abnormal, the hydraulic fluid returning from the first hydraulic actuator is not supplied (not regenerated) to the second hydraulic actuator even if the values measured by the sensor device satisfy the regenerative conditions. Thus, even if an abnormality occurs in the sensor device, it is possible to ensure that the operation of the hydraulic actuators matches the operator's operation.

Effect of the Invention

The invention ensures that the operation of the hydraulic actuators matches the operator's operation even if an abnormality occurs in the sensor device. Other problems to be solved by the invention and other structures and advantages of the invention will become apparent by the description of the following embodiments.

MODES FOR CARRYING OUT THE INVENTION

We now describe the structures and operation of hydraulic drive systems according to Embodiments 1 to 3 of the invention with reference to the accompanying drawings. A hydraulic drive system drives driven components (boom, arm, and the like) of a work machine (hydraulic excavator or the like) using hydraulic fluid.

Figure 12:
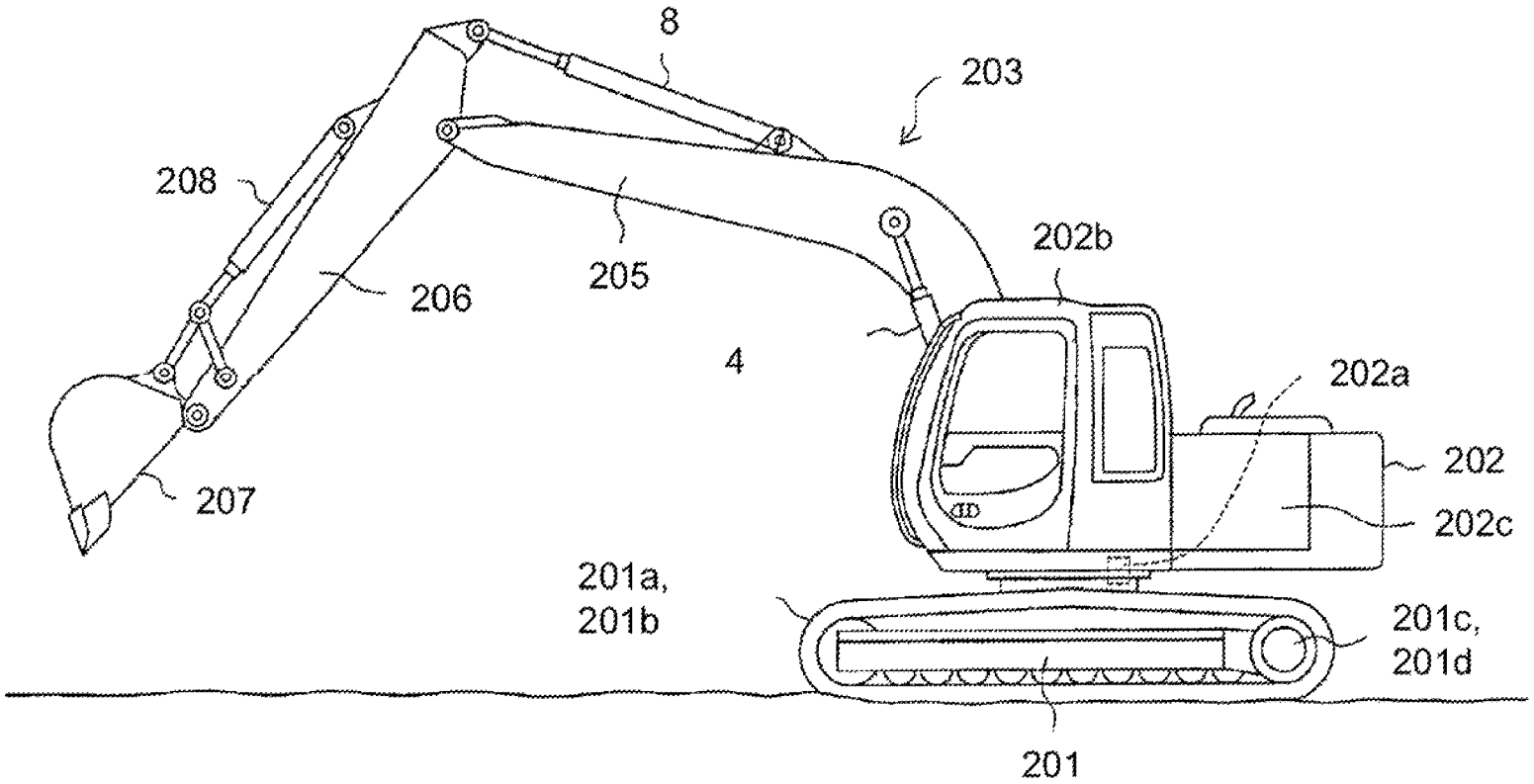
FIG. 12 is an external view of a hydraulic excavator on which the hydraulic drive system of Embodiment 1, 2, or 3 of the invention is installed.

Referring to FIG. 12, we first describe the structure of a hydraulic excavator as an example of the work machine (construction machine). FIG. 12 is an external view of a hydraulic excavator on which hydraulic drive system according to Embodiment 1, 2, or 3 of the invention is installed.

The hydraulic excavator includes a lower travel structure 201, an upper swing structure 202, and a front work device 203. The lower travel structure 201 includes left and right crawler-type travel devices 201*a* and 201*b* (only one side is illustrated), which are driven by left and right travel motors 201*c* and 201*d* (only one side is illustrated). The upper swing structure 202 is mounted atop the lower travel structure 201 in a swingable manner and swung by a swing motor 202*a*. The front work device 203 is attached to the front of the upper swing structure 202 in a vertically pivotable manner. A cabin (operating room) 202*b* is provided on the upper swing structure 202. Provided inside the cabin 202*b* are operation devices such as operation levers, travel operation pedal devices, and the like.

The front work device 203 is a multi-joint structure including a boom 205 (first driven component), an arm 206 (second driven component), and a bucket 207. The boom 205 pivots in up and down directions with respect to the upper swing structure 202 by the expansion and contraction of a boom cylinder 4 (first hydraulic actuator). The arm 206 pivots in up and down directions and in front and back directions with respect to the boom 205 by the expansion and contraction of an arm cylinder 8 (second hydraulic actuator). The bucket 207 pivots in up and down directions and in front and back directions with respect to the arm 206 by the expansion and contraction of a bucket cylinder 208.

Embodiment 1

Figure 1:
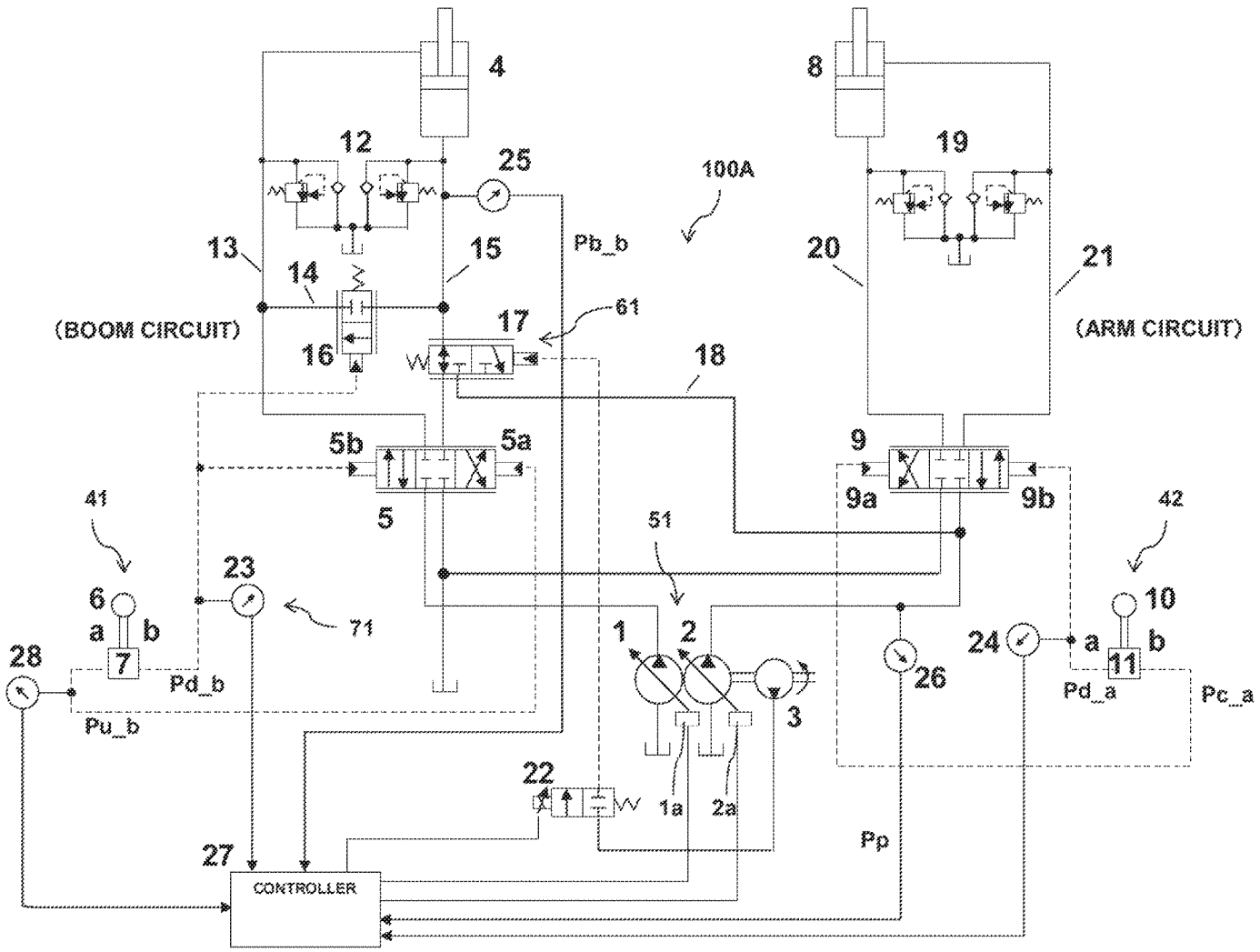
FIG. 1 is a configuration diagram of a hydraulic drive system according to Embodiment 1 of the invention.

Referring now to FIG. 1, we describe the structure of a hydraulic drive system 100A. FIG. 1 is a configuration diagram of the hydraulic drive system 100A of Embodiment 1 of the invention. For simplification purposes, in FIG. 1, only the boom and arm circuits of the hydraulic excavator are extracted and illustrated.

A hydraulic pump 1 is a variable displacement hydraulic pump and supplies hydraulic fluid to a control valve 5. The hydraulic pump 1 also communicates with other actuators not illustrated, and its delivery flow rate is controlled by a controller 27 (controller) in response to the operation of the operation levers of the other actuators.

A hydraulic pump 2 is a variable displacement hydraulic pump. The delivery flow rate of the hydraulic pump 2 is controlled by the controller 27. The hydraulic pump 2 supplies hydraulic fluid to a control valve 9. The hydraulic fluid from the hydraulic pump 1 is guided to the bottom side of the boom cylinder 4 via the control valve 5 and a bottom-side line 15. The hydraulic fluid from the pump 1 is also guided to the rod side of the boom cylinder 4 via the control valve 5 and a rod-side line 13.

The hydraulic pumps 1 and 2 constitute a hydraulic pump device 51. The hydraulic pump device 51 supplies hydraulic fluid to the boom cylinder 4 (first hydraulic actuator) and the arm cylinder 8 (second hydraulic actuator).

The hydraulic pumps 1 and 2 include regulators 1*a* and 2*a*, respectively. The regulators 1*a* and 2*a* are controlled by control signals from the controller 27, thereby controlling the tilting angles (displacements) of the hydraulic pumps 1 and 2 and hence their delivery flow rates.

A pilot valve 7 attached to an operation lever 6 generates pilot pressures based on the operation amount of the operation lever 6. The pilot pressure Pu_b generated during a raising side operation is guided to an operation port 5*a* of the control valve 5 via a raising side pilot line, thereby performing a switch/control operation on the control valve 5 based on the pilot pressure.

The pilot pressure Pd_b generated during a lowering side operation is guided to an operation port 5*b* of the control valve 5 via a lowering side pilot line, thereby performing a switch/control operation on the control valve 5 based on the pilot pressure. The pilot pressure Pd_b is also guided to a communication control valve 16, thereby performing a switch/control operation on the communication control valve 16.

The operation lever 6 and the pilot valve 7 constitute a first operation device 41 for operating the boom cylinder 4 (first hydraulic actuator). The control valve 5 adjusts the flow rate of the returning fluid from the boom cylinder 4 (first hydraulic actuator).

A make-up overload relief valve 12 is provided between the bottom-side line 15 and the rod-side line 13 such that it diverges from each. The overload relief valve 12 prevents devices from being damaged due to pressure getting too high and reduces the occurrence of cavitation resulting from negative pressure.

A communicating line 14 is provided on the bottom-side line 15 of the boom cylinder 4 to regenerate the hydraulic fluid of the bottom to the rod. The communication control valve 16 is provided on the communicating line 14. As described above, the communication control valve 16 is operated by the pilot pressure Pd_b. When the communication control valve 16 opens, it sends the hydraulic fluid of the boom cylinder 4 to the rod, thereby preventing the rod from having a negative pressure.

A regeneration control valve 17 is also provided on the bottom-side line 15 to regenerate the fluid discharged from the boom cylinder 4 to the outlet of the hydraulic pump 2. One side's port of the regeneration control valve 17 communicates with the control valve 5 while the other communicates with a regenerative-side line 18.

Here, the regeneration control valve 17 (regenerative valve), the regenerative-side line 18 (regenerative passage), and a solenoid proportional valve 22 (first solenoid valve) constitute a regenerative device 61 for supplying the returning fluid from the boom cylinder 4 (first hydraulic actuator) to the arm cylinder 8 (second hydraulic actuator). The regeneration control valve 17 of the regenerative device 61 is a directional control valve having a port through which the returning fluid from the boom cylinder 4 is supplied to the arm cylinder 8 and a port through which the returning fluid from the boom cylinder 4 is discharged to the control valve 5. This allows simultaneous control of, for example, the regeneration flow rate and bleed flow rate.

The hydraulic fluid from the hydraulic pump 2 is guided to bottom side of the arm cylinder 8 via the control valve 9 and a bottom-side line 20, and also guided to rod side via a rod-side line 21.

A pilot valve 11 attached to an operation lever 10 generates pilot pressures based on the operation amount of the operation lever 10. The pilot pressure Pc_a generated by the operation lever 10 being operated to the crowding side is guided to an operation port 9*a* of the control valve 9 via a crowding-side pilot line, thereby performing a switch/control operation on the control valve 9 based on that pilot pressure.

The pilot pressure Pd_a generated by the operation lever 10 being operated to the dumping side is guided to an operation port 9*b* of the control valve 9 via a dumping-side pilot line, thereby performing a switch/control operation on the control valve 9 based on that pilot pressure.

The operation lever 10 and the pilot valve 11 constitute a second operation device 42 that operates the arm cylinder 8 (second hydraulic actuator).

A make-up overload relief valve 19 is provided between the bottom-side line 20 and the rod-side line 21 such that it diverges from each. The overload relief valve 19 prevents devices from being damaged due to pressure getting too high and reduces the occurrence of cavitation resulting from negative pressure.

The solenoid proportional valve 22 is operated by control signals from the controller 27. The solenoid proportional valve 22 converts the hydraulic fluid supplied from a pilot pump 3 into a desired Pi pressure and guides the pressure to the regeneration control valve 17 to control its opening degree.

The pilot pressure Pu_b on the raising side of the pilot valve 7 and the pilot pressure Pd_b on the lowering side of the pilot valve 7 are measured by pressure sensors 28 and 23, respectively. The bottom pressure Pb_b of the boom cylinder 4 is measured by a pressure sensor 25, and the pump pressure is measured by a pressure sensor 26. Each of the measured pressures is input to the controller 27. The controller 27 performs control operations based on the pilot pressures, bottom pressure, and pump pressure input and outputs control commands to the solenoid proportional valve 22 and the pumps 1 and 2.

Next, we describe a case where a boom lowering operation is performed.

When the operation lever 6 is moved in the boom lowering direction, the pilot pressure Pd_b generated from the pilot valve 7 is input to the operation port 5*b* of the control valve 5 and the communication control valve 16. With this, the control valve 5 is switched to allow the bottom-side line 15 to communicate with a tank. As a result, the bottom hydraulic fluid of the boom cylinder 4 is discharged to the tank, whereby the cylinder is lowered. Likewise, the communication control valve 16 is also switched to regenerate the hydraulic fluid from the bottom-side line 15 to the rod-side line 13. Also, the controller 27 outputs a tilting command to the hydraulic pump 1 and thus allows the hydraulic fluid of the hydraulic pump 1 to flow to the rod-side line 13 so that the rod-side line 13 does not have a negative pressure.

Next, we describe a case where a boom lowering operation and an arm drive operation are performed at the same time. In principle, the same explanation applies when an arm dumping operation is performed and when an arm crowding operation performed. Thus, we take an arm dumping operation for example.

The pilot pressure Pd_a generated in the pilot valve 11 is input to the operation port 9*b* of the control valve 9. With this, the control valve 9 is switched to allow the bottom-side line 20 to communicate with the tank and the rod-side line 21 to communicate with the hydraulic pump 2, thereby discharging the hydraulic fluid of the bottom into the tank. Also, the hydraulic fluid of the hydraulic pump 2 flows to the rod side, thereby contracting the arm cylinder 8.

The controller 27 receives signals from the pressure sensors 23, 24, 25, 26, and 28 and outputs a signal to the solenoid proportional valve 22 based on the logic described later. The regeneration control valve 17 is controlled by a pressure signal from the solenoid proportional valve 22, whereby the bottom hydraulic fluid of the boom cylinder 4 is regenerated to the arm cylinder 8 via the regeneration control valve 17.

The pressure sensor 23 or 28 (first operation amount sensor) measures the operation amount of the first operation device 41. The pressure sensor 24 (second operation amount sensor) measures the operation amount of the second operation device 42. The pressure sensor 25 (first pressure sensor) measures the bottom-side hydraulic pressure of the boom cylinder 4 (first hydraulic actuator). The pressure sensor 26 (second pressure sensor) measures the pressure of the hydraulic fluid supplied from the hydraulic pump device 51. The pressure sensors 23, 24, 25, 26, and 28 constitute a sensor device 71.

The pilot pressure Pd_b generated in the pilot valve 7 is input to the operation port 5*b* of the control valve 5 and the communication control valve 16. This allows the control valve 5 and the communication control valve 16 to be switched. As a result, the hydraulic fluid discharged from the bottom of the boom cylinder 4 is regenerated, and the hydraulic fluid of the hydraulic pump 1 is caused to flow into the rod-side line 13 of the boom cylinder so that the rod-side line 13 does not have a negative pressure.

Further, the controller 27 outputs tilting commands to the hydraulic pump 2, whereby the pump flow rate is reduced based on the regeneration flow rate of the regeneration control valve 17 for the purpose of reducing fuel consumption.

<Control Logic>

Figure 2:
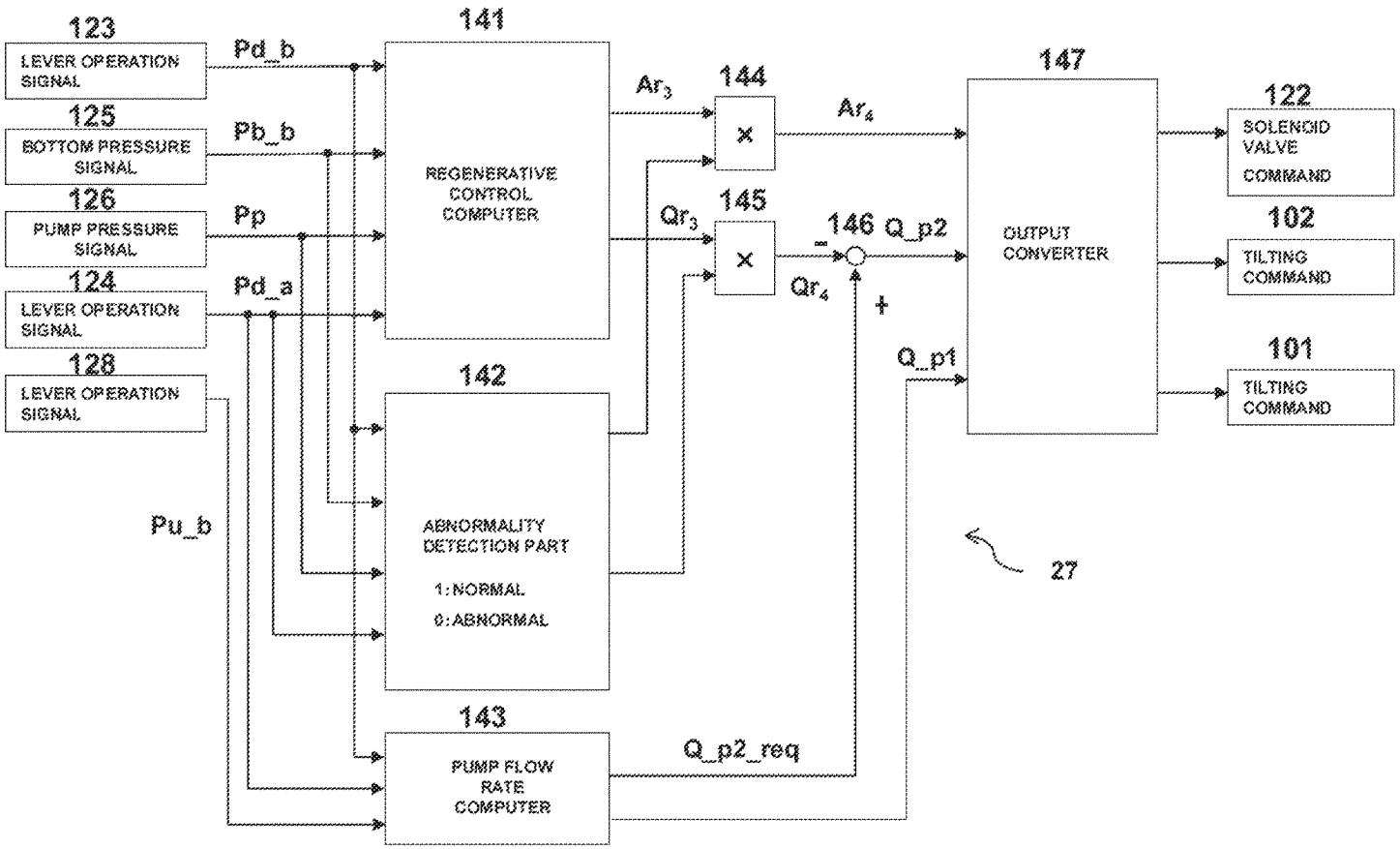
FIG. 2 is a diagram illustrating the control logic of the controller of FIG. 1.

We now describe the control logic used for a computation in the controller 27 with reference to FIG. 2. FIG. 2 is a diagram illustrating the control logic of the controller 27 of FIG. 1.

As illustrated in FIG. 2, the controller 27 includes a regenerative control computer 141, an abnormality detection part 142, a pump flow rate computer 143, integrators 144 and 145, a subtractor 146, and an output converter 147.

In FIG. 2, the lever operation signal 123 represents a signal indicative of the operation amount of the operation lever 6 (pilot pressure Pd_b), which is measured by the pressure sensor 23. The bottom pressure signal 125 represents a signal indicative of the bottom pressure Pb_b of the boom cylinder 4, which is measured by the pressure sensor 25. The pump pressure signal 126 represents a signal indicative of the pump pressure Pp measured by the pressure sensor 26. The lever operation signal 124 represents a signal indicative of the operation amount of the operation lever 10 (pilot pressure Pd_a), which is measured by the pressure sensor 24. The lever operation signal 128 represents a signal indicative of the operation amount of the operation lever 6 (pilot pressure Pu_b), which is measured by the pressure sensor 28.

Figure 3:
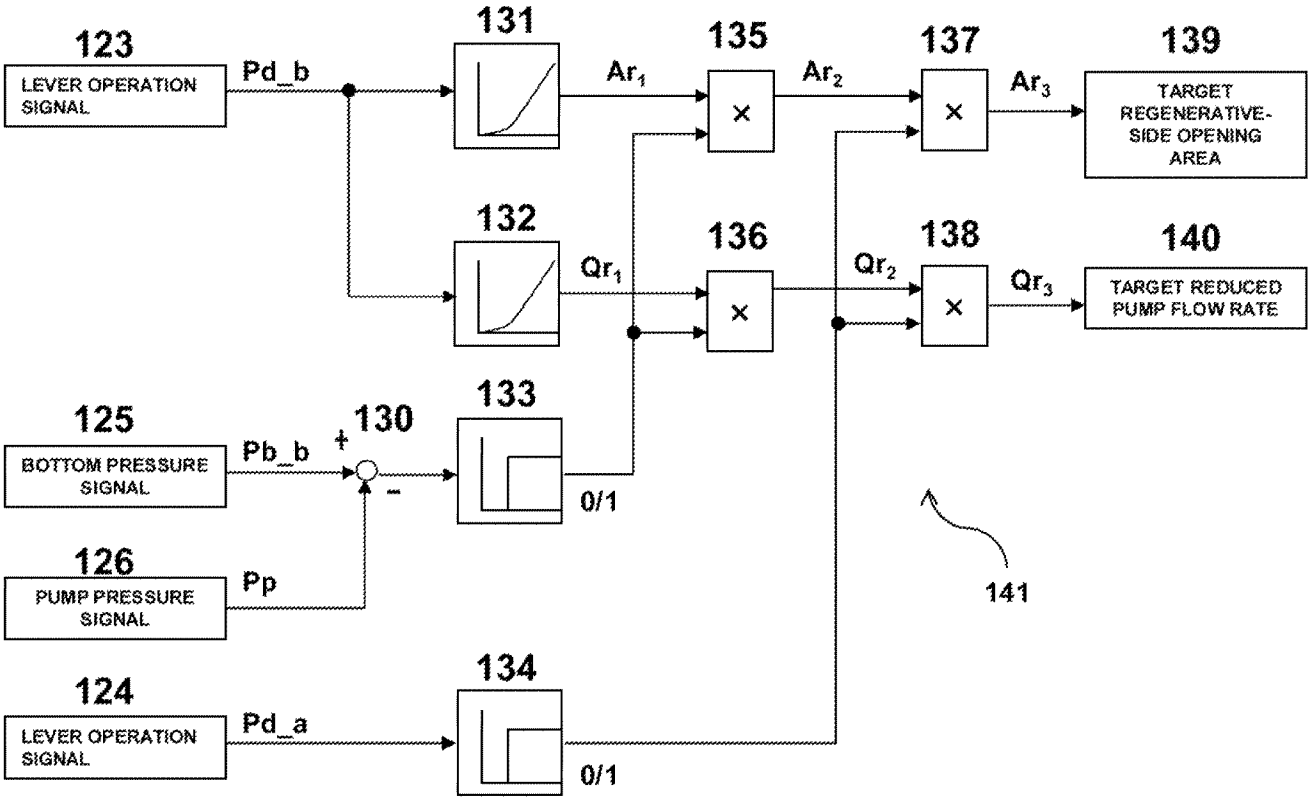
FIG. 3 is a configuration diagram of the regenerative control computer of FIG. 2.

The regenerative control computer 141 computes the target regenerative-side opening area $Ar_3$ of the regeneration control valve 17 and outputs it to the integrator 144. The regenerative control computer 141 also computes a target reduced pump flow rate $Qr_3$ and outputs it to an integrator 135. The details of the regenerative control computer 141 are illustrated in FIG. 3. FIG. 3 is a configuration diagram of the regenerative control computer 141 of FIG. 2.

As illustrated in FIG. 3, the regenerative control computer 141 includes function generators 131 to 134 and integrators 135 to 138.

Figure 4:
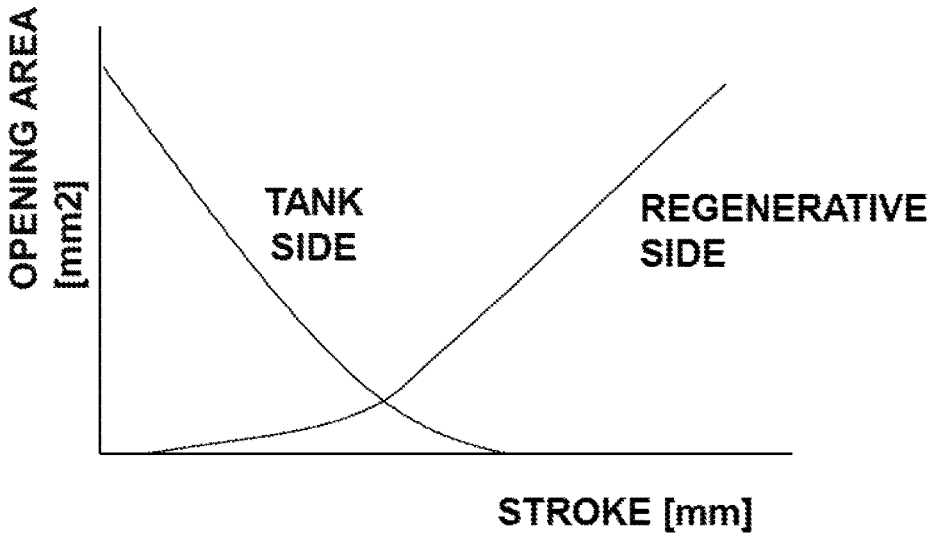
FIG. 4 is a graph illustrating the opening area of the regeneration control valve of FIG. 1.

The function generator 131 computes the regenerative-side opening area $Ar_1$ of the regeneration control valve 17 based on the lever operation signal 123 (value: Pd_b). A graph of the opening area of the regeneration control valve 17 is illustrated in FIG. 4. FIG. 4 is a graph illustrating the opening area of the regeneration control valve 17 of FIG. 1.

In FIG. 4, the horizontal axis represents a spool stroke of the regeneration control valve 17 while the vertical axis represents the opening area. When the spool stroke is smallest, the valve 17 opens on the tank side and the opening area on the regenerative side closes. Thus, the hydraulic fluid is not regenerated. When the stroke is gradually moved to the right, the valve 17 begins to close on the tank side and open on the regenerative side, allowing the hydraulic fluid discharged from the boom bottom to flow into the regenerative-side line 18. By adjusting the stroke, the opening area on the regenerative side can be changed, and the regeneration flow rate can also be controlled.

In other words, when the lever operation signal 123 (value: Pd_b) is large, the regeneration flow rate is increased by expanding the stroke of the regeneration control valve 17 and thus increasing the opening area $Ar_1$ on the regenerative side. It is preferred that a table of the function generator 131 and the opening area graph of the regeneration control valve 17 be adjusted such that the hydraulic fluid discharged from the bottom side of the boom cylinder at that time is the same as when regeneration is not performed.

Referring again to FIG. 3, the function generator 132 is used to obtain a reduced pump flow rate $Qr_1$ based on the lever operation signal 123 (value: Pd_b). The function generator 132 can be set based on the characteristics of the opening area $Ar_1$ set with the function generator 131. That is, since the regeneration flow rate increases as the opening area $Ar_1$ output from the function generator 131 becomes larger, the reduced pump flow rate $Qr_1$ needs to be set larger accordingly.

A subtractor 130 computes the differential pressure between the bottom pressure signal 125 (value: Pb_b) and the pump pressure signal 126 (value: Pp). The function generator 133 outputs a value of 1 when the differential pressure exceeds a set value and outputs a value of 0 when the differential pressure is equal to or less than the set value.

The integrator 135 computes the regenerative-side opening area $Ar_1$ of the regeneration control valve 17 output from the function generator 131 such that when the differential pressure is lower than the set value, it is determined that regeneration cannot be performed and such that a regenerative-side opening area $Ar_2$ is set to 0. Also, the integrator 135 performs a computation such that when the differential pressure is higher than the set value, it is determined that regeneration can be performed and such that the regenerative-side opening area $Ar_2$ becomes equal to the value $Ar_1$ output from the function generator 131.

In other words, the integrator 135 outputs the integrated value of the output value $Ar_r$ of the function generator 131 and the output value (0 or 1) of the function generator 133 as the regenerative-side opening area $Ar_2$.

Similar to the above, the integrator 136 computes the reduced pump flow rate $Qr_1$ output from the function generator 132 such that when the differential pressure is lower than the set value, it is determined that regeneration cannot be performed and such that a reduced pump flow rate $Qr_2$ is set to 0. Also, the integrator 136 performs a computation such that when the differential pressure is higher than the set value, it is determined that regeneration can be performed and such that the reduced pump flow rate $Qr_2$ becomes equal to the value $Qr_1$ output from the function generator 132.

In other words, the integrator 136 outputs the integrated value of the output value $Qr_1$ of the function generator 132 and the output value (0 or 1) of the function generator 133 as the reduced pump flow rate $Qr_2$.

The lever operation signal 124 (value: Pd_a) is input to the function generator 134. The function generator 134 outputs 0 when the input amount indicated by the lever operation signal 124 (pilot pressure Pd_a) is equal to or less than a fixed value and outputs 1 when the amount is equal to or greater than the fixed value. When the lever operation signal 124, that is, the operation amount of the operation lever 10 is low, the control valve 9 is somewhat closed. In that case, even if the regenerative-side opening area of the regeneration control valve 17 is increased, the flow rate hardly flows to the arm rod side. Conversely, if the lever operation signal 124 is sufficiently high, the control valve 9 opens, allowing a sufficient amount of regeneration flow rate to flow thereto. Thus, the function generator 134 determines whether regeneration is possible or not based on the lever operation signal 124 (value: Pd_a).

The integrator 137 computes the regenerative-side opening area $Ar_1$ of the regeneration control valve 17 output from the function generator 131 such that when the lever operation signal 124 (value: Pd_a) is lower than a set value, it is determined that regeneration cannot be performed and such that a regenerative-side opening area $Ar_3$ is set to 0. Also, the integrator 137 performs a computation such that when the lever operation signal 124 (value: Pd_a) is higher than the set value, it is determined that regeneration can be performed and such that the regenerative-side opening area $Ar_3$ becomes equal to the value output from the function generator 131.

In other words, the integrator 137 outputs the integrated value $Ar_3$ of the output value $Ar_2$ of the integrator 135 and the output value (0 or 1) of the function generator 134 as a target regenerative-side opening area 139.

Similar to the above, the integrator 138 computes the reduced pump flow rate Qr1 output from the function generator 132 so that when the lever operation signal 124 (value: Pd_a) is lower than a set value, it is determined that regeneration cannot be performed and such that a reduced pump flow rate $Qr_3$ is set to 0. Also, the integrator 138 performs a computation such that when the lever operation signal 124 is higher than the set value, it is determined that regeneration can be performed and such that the reduced pump flow rate $Qr_3$ becomes equal to the value output from the function generator 132.

In other words, the integrator 138 outputs the integrated value $Qr_3$ of the output value $Qr_2$ of the integrator 136 and the output value (0 or 1) of the function generator 134 as a target reduced pump flow rate 140.

As described above, the output $Ar_3$ of the integrator 137 is output as the target regenerative-side opening area 139, and the output $Qr_3$ of the integrator 138 is output as the target reduced pump flow rate 140.

Referring back to FIG. 2, the abnormality detection part 142 receives various sensor signals and determines whether the sensor signals are normal or abnormal. The abnormality detection part 142 outputs 1 to the integrator 144, 145 when they are normal and outputs 0 to the integrator 144, 145 when they are abnormal.

Figure 5A:
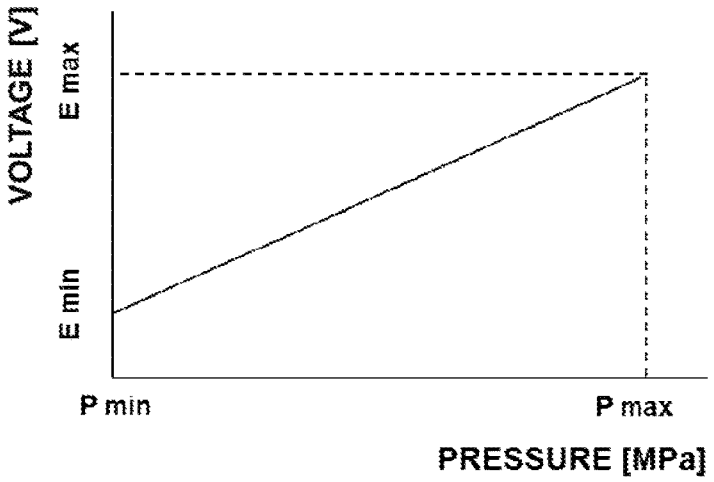
FIG. 5A is a graph illustrating the characteristics of the pressure sensors of FIG. 1.
Figure 5B:
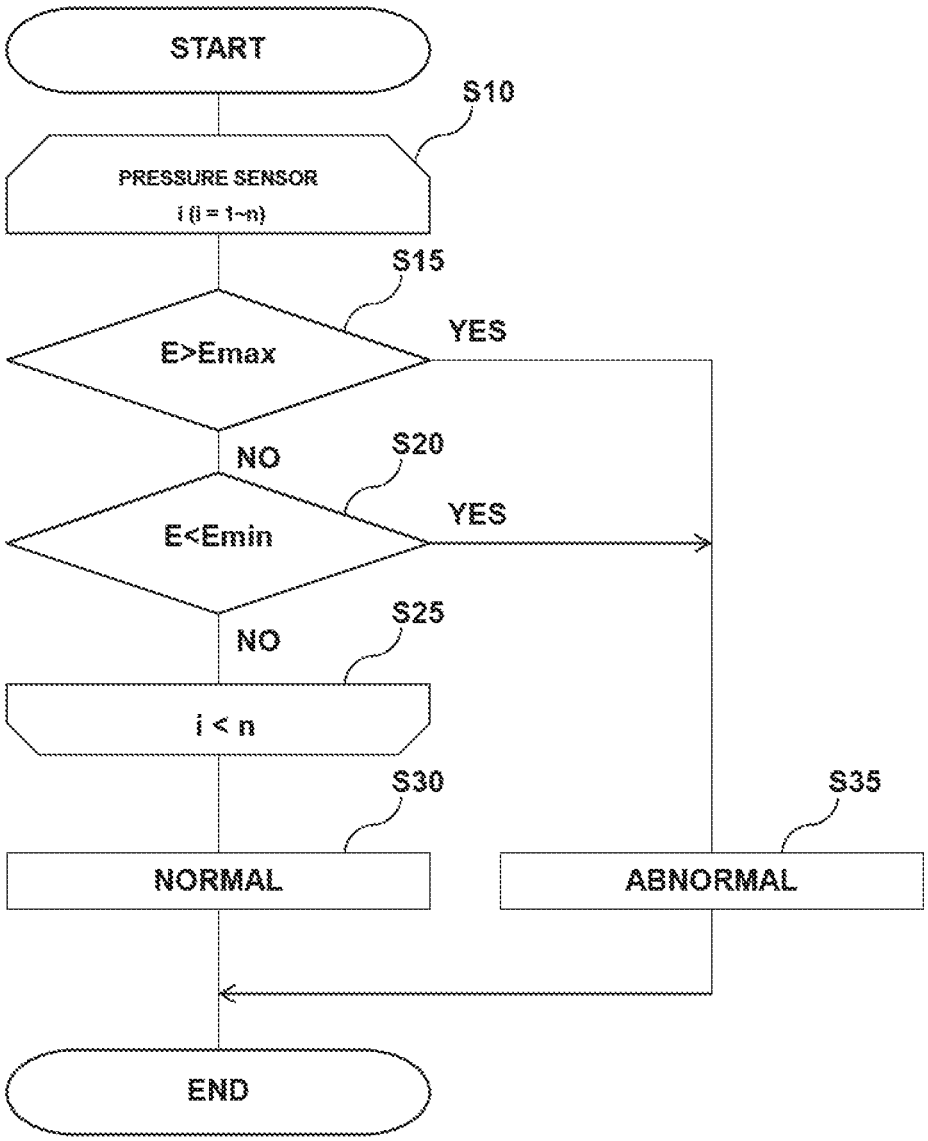
FIG. 5B is a flowchart illustrating the determination process performed by the abnormality detection part of FIG. 2.

Next, we describe the operation of the abnormality detection part 142 in detail with reference to FIG. 5. FIG. 5A is a graph illustrating the characteristics of the pressure sensors of FIG. 1. FIG. 5B is a flowchart illustrating the determination process performed by the abnormality detection part 142 of FIG. 2.

In FIG. 5A, the horizontal axis represents the pressure input to a pressure sensor while the vertical axis represents output voltage of the pressure sensor. The output voltage for the minimum pressure Pmin, determined by the specification of the pressure sensor, is Emin while the output voltage for the maximum pressure Pmax is Emax. Usually, the output voltage Emin is set at a value higher than 0V while the output voltage Emax is set at a value lower than the power supply voltage.

When the pressure sensor has a wire disconnected or short-circuits, the output voltage becomes 0V or close to the power supply voltage, and the sensor outputs a voltage that is not included in the range of Emin to Emax. The abnormality detection part 142 determines that the sensor is abnormal when the output voltage is out of the range of Emin to Emax. The abnormality detection part 142 outputs 0 to the integrators 144 and 145 when it determines that any sensor is abnormal and outputs 1 when all the sensors are normal.

In other words, the abnormality detection part 142 determines that a pressure sensor is abnormal when the electric signal output from the pressure sensor becomes smaller than the predetermined lower limit Emin or higher than the predetermined upper limit Emax. This allows determination of abnormalities of the sensor device 71 with a simple structure.

Different sets of Emax and Emin can be set for the pressure sensors. For instance, a lower-limit voltage Emin1 corresponding to a lower-limit pressure Pmin1 and an upper-limit output voltage Emax1 corresponding to an upper-limit pressure Pmax1 are set for the pressure sensors 23 and 24, which measure the pilot pressures output from the first operation device 41 and the second operation device 42. On the other hand, a lower-limit output voltage Emin2 corresponding to a lower-limit pressure Pmin2 and an upper-limit output voltage Emax2 corresponding to an upper-limit pressure Pmax2 are set for the pressure sensor 25, which measures the hydraulic pressure on the bottom side of the boom cylinder 4, and for the pressure sensor 26, which measures the pump pressure. In the above, Pmin1≤Pmin2, Pmax1≤Pmax2, Emin1≤Emin2, and Emax2≤Emax3.

Referring to FIG. 5B, we describe the determination process performed by the abnormality detection part 142. For simplification purposes, assume that there are an n number of pressure sensors and each pressure sensor is identified by an index i (i–1 to n). The abnormality detection part 142 executes the following steps using, for example, predetermined cycles as event triggers.

The abnormality detection part 142 sets a pressure sensor of interest (Step S10). The abnormality detection part 142 determines whether the output voltage E of the pressure sensor is larger than the maximum voltage Emax or not (Step S15). When the output voltage E of the pressure sensor is larger than the maximum voltage Emax (Step S15; Yes), the abnormality detection part 142 determines that the sensor device 71 including this pressure sensor is abnormal (sensor failure) (Step S35). On the other hand, if the output voltage E of the pressure sensor is equal to or less than the maximum voltage Emax (Step S15; No), the process proceeds to Step S20.

The abnormality detection part 142 determines whether or not the output voltage E of the pressure sensor is smaller than the minimum voltage Emin (Step S20). If the abnormality detection part 142 determines that the output voltage E of the pressure sensor is smaller than the minimum voltage Emin (Step S20; Yes), it determines that the sensor device 71 is abnormal. On the other hand, when the abnormality detection part 142 determines that the output voltage E of the pressure sensor is larger than the minimum voltage Emin (Step S20; No), the process proceeds to Step S25.

The abnormality detection part 142 determines whether or not the index of the pressure sensor is smaller than n (Step S25). If the index of the pressure sensor is equal to n, the process proceeds to Step S30. In order for the process to proceed to Step S30, the output voltages E of all the pressure sensors need to be in the predetermined voltage range (Emin≤E≤Emax). The abnormality detection part 142 determines that the sensor device 71 is normal (not broken down) (Step S30), terminating the process. As stated above, the abnormality detection part 142 outputs 1 when the sensor device 71 is normal and outputs 0 when the sensor device 71 is abnormal.

Referring again to FIG. 2, when the abnormality detection part 142 determines that each sensor signal is normal, the signal which is input from the regenerative control computer 141 to the integrator 144 or 145 is output as it is. If the abnormality detection part 142 determines that any sensor signal is abnormal, the input signal is multiplied by 0, which is output by the abnormality detection part 142. As a result, the integrator 144 or 145 outputs a signal of 0.

In other words, if the abnormality detection part 142 determines that any sensor signal is abnormal, a target regenerative-side opening area $Ar_4$ of the regeneration control valve 17 and a target reduced pump flow rate $Qr_4$ are set to 0, thereby canceling regeneration from the boom cylinder 4 to the arm cylinder 8 and at the same time canceling the later-described control for reducing the delivery flow rate of the hydraulic pump 2 by the value of the regeneration flow rate.

Figure 6:
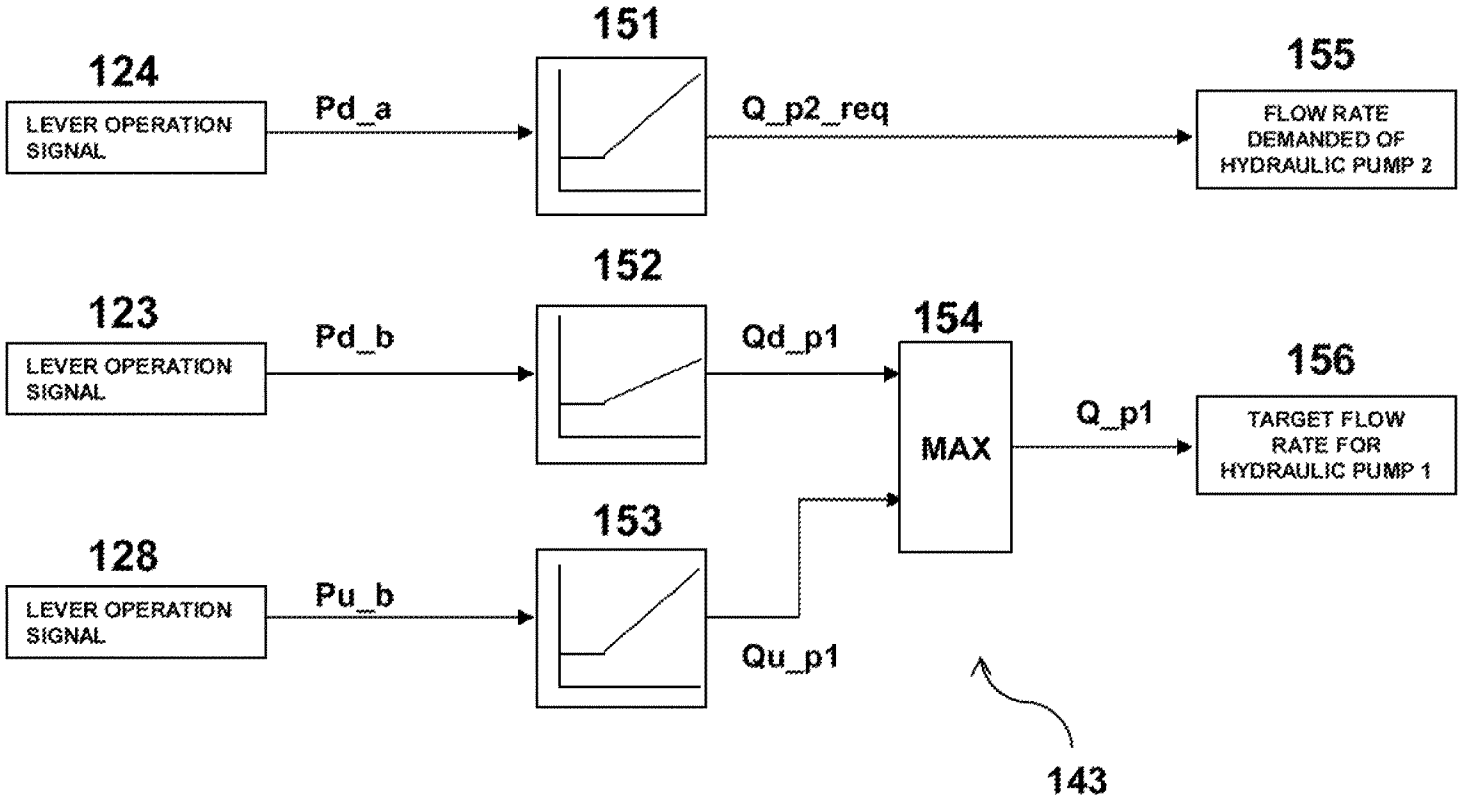
FIG. 6 is a configuration diagram of the pump flow rate computer of FIG. 1.

The pump flow rate computer 143 executes the control logic for controlling the flow rate of the hydraulic pump 1 based on the lever operation signals 123 and 128 and controlling the flow rate of the hydraulic pump 2 based on the lever operation signal 124, the details of which are illustrated in FIG. 6. FIG. 6 is a configuration diagram of the pump flow rate computer 143 of FIG. 1.

As illustrated in FIG. 6, the pump flow rate computer 143 includes function generators 151 to 153 and a maximum selector 154.

Referring to FIG. 6, the lever operation signal 124 is input to the function generator 151, and the function generator 151 outputs a demanded flow rate 155 of the hydraulic pump 2 such that a pump flow rate Q_p2_req corresponding to the operation of the lever is obtained.

The function generator 151 has such a characteristic that when the function generator 151 does not receive the lever operation signal 124 (value: Pd_a), the hydraulic pump 2 outputs a minimum flow rate. The reason is to improve responsiveness when the operation lever is operated and to prevent the seizure of the hydraulic pump. As the lever operation signal 124 becomes larger, the flow rate of the hydraulic pump 2 is increased accordingly, thereby increasing the hydraulic fluid flowing into the arm cylinder 8. With this, the arm cylinder speed corresponding to the operation amount can be achieved.

The lever operation signal 123 (value: Pd_b) is input to the function generator 152 while the lever operation signal 128 (value: Pu_b) is input to the function generator 153. The function generators 152 and 153 output to the maximum selector 154 the flow rate Qd_p1 of the hydraulic pump 1 corresponding to a boom lowering side operation and the flow rate Qu_p1 of the hydraulic pump 1 corresponding to a boom raising side operation, respectively.

Similar to the function generator 151, the function generators 152 and 153 have such characteristics that when they do not receive the lever operation signals, the hydraulic pump 1 outputs a minimum flow rate. As the lever operation signal becomes larger, the flow rate of the hydraulic pump 1 is increased accordingly, thereby increasing the hydraulic fluid flowing into the boom cylinder 4. With this, the boom cylinder speed corresponding to the operation amount can be achieved.

The function generator 152 has the characteristic that a flow rate increase based on a lever operation signal is smaller than in the case of the function generator 153. This is because the lever operation signal 123 (value: Pd_b) is a signal for boom lowering side operation and the flow rate of the hydraulic fluid sent from the hydraulic pump 1 to the boom cylinder 4 at the time of boom lowering operation does not need to be large. In other words, while the hydraulic pump 1 needs to supply the hydraulic fluid such that the rod of the boom cylinder 4 does not have a negative pressure at the time of boom lowering operation, a larger flow rate is not necessary than at the time of boom raising operation because the hydraulic fluid is directed from the bottom to the rod by the communication control valve 16 and also because the rod area is about half as large as the bottom area.

The maximum selector 154 outputs as a target flow rate 156 (value: Q_p1) of the hydraulic pump 1 the larger of the output value Qd_p1 of the function generator 152 and the output value Qu_p1 of the function generator 153.

Referring back to FIG. 2, the subtractor 146 receives the demanded flow rate Q_p2_req of the hydraulic pump 2 and the target reduced pump flow rate $Qr_4$, subtracts the target flow rate of the hydraulic pump 2, that is, the regeneration flow rate $Qr_2$, from the demanded flow rate Q_p2_req of the hydraulic pump 2, and outputs the obtained value as a target flow rate Q_p2 of the hydraulic pump 2.

The output converter 147 receives the output $Ar_4$ of the integrator 144 and the output Q_p2 of the subtractor 146. The output converter 147 further receives the target flow rate 156 (value: Q_p1) of the hydraulic pump 1 from the pump flow rate computer 143. They are output respectively as a solenoid valve command 122 for the solenoid proportional valve 22, a tilting command 102 for the hydraulic pump 2, and a tilting command 101 for the hydraulic pump 1.

The solenoid proportional valve 22 is thus controlled and outputs a drive pressure to control the regeneration control valve 17 such that it has the desired opening area. Also, the hydraulic pump 2 is controlled by the tilting command 102 such that it has the desired tilting angle and delivers the pump flow rate from which the regeneration flow rate has been subtracted. Further, the hydraulic pump 1 is controlled by the tilting command 101 such that it has the desired tilting angle and sends the hydraulic fluid to the boom cylinder 4 at a particular flow rate.

Described next is operation.

As illustrated in FIG. 3, after the lever operation signal 123 (value: Pd_b) is input, the function generators 131 and 132 output the regenerative-side opening area $Ar_1$ of the regeneration control valve 17 and the reduced pump flow rate $Qr_1$, respectively.

The subtractor 130 computes the differential pressure from the bottom pressure signal 125 (value: Pb_b) and the pump pressure signal 126 (value: Pp), and the function generator 133 determines whether regeneration is possible or not.

Likewise, the function generator 134 determines based on the lever operation signal 124 (value: Pd_a) whether regeneration is possible or not.

If it is determined from the computed differential pressure and the lever operation signal 124 (value: Pd_a) that regeneration is possible, the regenerative-side opening area $Ar_1$ of the regeneration control valve 17 output from the function generator 131 is output as the target regenerative-side opening area 139 (value: $Ar_3$) via the integrators 135 and 137, and the reduced pump flow rate $Qr_1$ output from the function generator 132 is output as the target reduced pump flow rate 140 (value: $Qr_3$) via the integrators 136 and 138.

As illustrated in FIG. 2, the abnormality detection part 142 determines whether the sensor signals are normal or abnormal. To the integrators 144 and 145, the abnormality detection part 142 outputs 1 when it determines that the sensor signals are normal and 0 when it determines that any sensor signal is abnormal.

If any sensor signal is abnormal, the target regenerative-side opening area $Ar_4$ and the target reduced pump flow rate $Qr_4$ are set to 0.

The subtractor 146 receives the demanded flow rate Q_p2_req of the hydraulic pump 2 from the pump flow rate computer 143 and the target reduced pump flow rate $Qr_4$ and outputs the target flow rate Q_p2 of the hydraulic pump 2, which is obtained by subtracting the regeneration flow rate $Qr_4$ from the pump flow rate.

The output converter 147 coverts the target regenerative-side opening area $Ar_4$, the target flow rate Q_p2 of the hydraulic pump 2, and the target flow rate Q_p1 of the hydraulic pump 1 into the solenoid valve command 122, the tilting command 102, and the tilting command 101, respectively, which are output to the solenoid proportional valve 22, the hydraulic pump 2, and the hydraulic pump 1, respectively.

When the abnormality detection part 142 determines that the sensors are normal, the target regenerative-side opening area 139 and the target reduced pump flow rate 140 are output as they are, and control is performed such that the desired opening area of the regeneration control valve and the desired pump flow rate are achieved. As a result, the regeneration control valve 17 controls and adjusts the hydraulic fluid discharged from the boom cylinder 4 and regenerates it to the hydraulic pump 2 via the regenerative-side line 18.

Also, the pump flow rate of the hydraulic pump 2 is reduced by the value of the regeneration flow rate, and the speed desired by the operator can be achieved. Moreover, the reduced pump flow rate leads to less fuel consumption.

If the abnormality detection part 142 determines that any sensor is abnormal, computation is performed from the abnormality detection part 142 such that the target regenerative-side opening area 139 and the target reduced pump flow rate 140 are set to 0. With this, speed adjustment is made based on the opening area of the control valve 5 that changes in response to the operation lever 6 without the regeneration control valve 17 being switched. Also, the flow rate of the hydraulic pump 2 becomes the flow rate determined by the operation lever 10, and the speed desired by the operator is achieved.

When the sensor device 71 is normal and the values measured by the sensor device 71 satisfy regenerative conditions, the controller 27 acts as a first control part that controls the regenerative device 61 such that the returning fluid from the boom cylinder 4 (first hydraulic actuator) is supplied to the arm cylinder 8 (second hydraulic actuator). When the sensor device 71 is abnormal, the controller 27 (first control part) controls the regenerative device 61 such that the returning fluid from the boom cylinder 4 is not supplied to the arm cylinder 8 even if the values measured by the sensor device 71 satisfy the regenerative conditions. The regenerative conditions are those that need to be met when the returning fluid from the boom cylinder 4 is supplied to the arm cylinder 8.

Further, when the sensor device 71 is normal and the values measured by the sensor device 71 satisfy the regenerative conditions, the controller 27 acts also as a second control part that controls the hydraulic pump device 51 such that delivery flow rate of the hydraulic pump device 51 is reduced based on the regeneration flow rate indicative of the flow rate at which the returning fluid from the boom cylinder 4 is supplied to the arm cylinder 8. When the sensor device 71 is abnormal, the controller 27 (second control part) cancels the control for reducing the delivery flow rate of the hydraulic pump device 51 even if the values measured by the sensor device 71 satisfy the regenerative conditions.

The advantageous effects of the present embodiment are described further in detail below.

As in the section of "Problems to Be Solved by the Invention," assume as an example a case where the boom bottom pressure is higher than the arm rod pressure, with an arm dumping operation being performed and no boom lowering operation being performed. In that case, if an abnormality occurs in the boom lowering pilot pressure sensor 23 and it is determined that a boom lowering operation is being performed, the regenerative control computer 141 determines that all the regenerative conditions have been met and outputs the target regenerative-side opening area 139 and the target reduced pump flow rate 140.

In the absence of the abnormality detection part 142, the target regenerative-side opening area 139 and the target reduced pump flow rate 140 are output as they are, as the solenoid valve command 122 and the tilting command 102 via the output converter 147. As a result, the regeneration control valve 17 is switched, reducing the flow rate of the hydraulic pump 2. Therefore, the hydraulic fluid at the boom bottom is regenerated to the arm rod, which may lower the boom cylinder in an unexpected manner and change the speed of the arm cylinder 8.

In the present embodiment, by contrast, when a sensor failure such as the above occurs, the abnormality detection part 142 outputs 0 to the integrators 144 and 145, thereby setting both of the target regenerative-side opening area 139 and the target reduced pump flow rate 140 to 0. As a result, since the output of the solenoid proportional valve 22 based on the solenoid valve command 122 can be reduced, the regeneration control valve 17 can be prevented from being switched in an unexpected manner, and the boom cylinder can be prevented from being lowered at a speed higher than a predictable speed.

In addition, since the demanded flow rate 155 of the hydraulic pump 2 is not reduced by the subtractor 146, the tilting command 102 becomes the output corresponding to the demanded flow rate 155 of the hydraulic pump. Thus, the flow rate of the hydraulic pump 2 does not change in an unexpected manner, and the speed of the arm cylinder 8 can be made equal to the speed desired by the operator.

As another example, assume a case where the arm rod pressure is higher than the boom bottom pressure during a boom-lowering arm-dumping operation. In that case, since the arm rod pressure is higher than the boom bottom pressure, the regeneration control valve is usually kept closed. However, if it is determined that the boom bottom pressure is higher due to an abnormality of the boom bottom pressure sensor, the function generator 133 of the regenerative control computer 141 outputs 1, which means that regeneration is possible, and the target regenerative-side opening area 139 then is output.

In the absence of the abnormality detection part 142, the target regenerative-side opening area 139 is output as it is, as the solenoid valve command 122 via the output converter 147, whereby the regeneration control valve 17 is switched. However, since the arm rod pressure is actually higher than the boom bottom pressure, the hydraulic fluid does not flow from the boom bottom to the arm rod even if the regeneration control valve is opened. Moreover, since the passage to the tank is throttled, the hydraulic fluid discharged from the boom bottom has nowhere to go. As a result, the boom cylinder suddenly decelerates or stops, by which the operator may find strange in operability.

In the present embodiment, by contrast, when a sensor failure such as the above occurs, the abnormality detection part 142 outputs 0 to the integrator 144, thereby setting the target regenerative-side opening area 139 to 0. As a result, since the output from the solenoid valve command 122 can be reduced, the regeneration control valve 17 can be prevented from being switched in an unexpected manner, and sudden deceleration or stop can be prevented.

Therefore, according to the present embodiment, the actuators are maintained at the speeds desired by the operator regardless of whether the sensors are normal or abnormal.

As described above, according to the present embodiment, it is possible to ensure that the operation of the hydraulic actuators (boom cylinder 4 and arm cylinder 8) matches the operator's operation even when an abnormality occurs in the sensor device 71.

Embodiment 2

Figure 7:
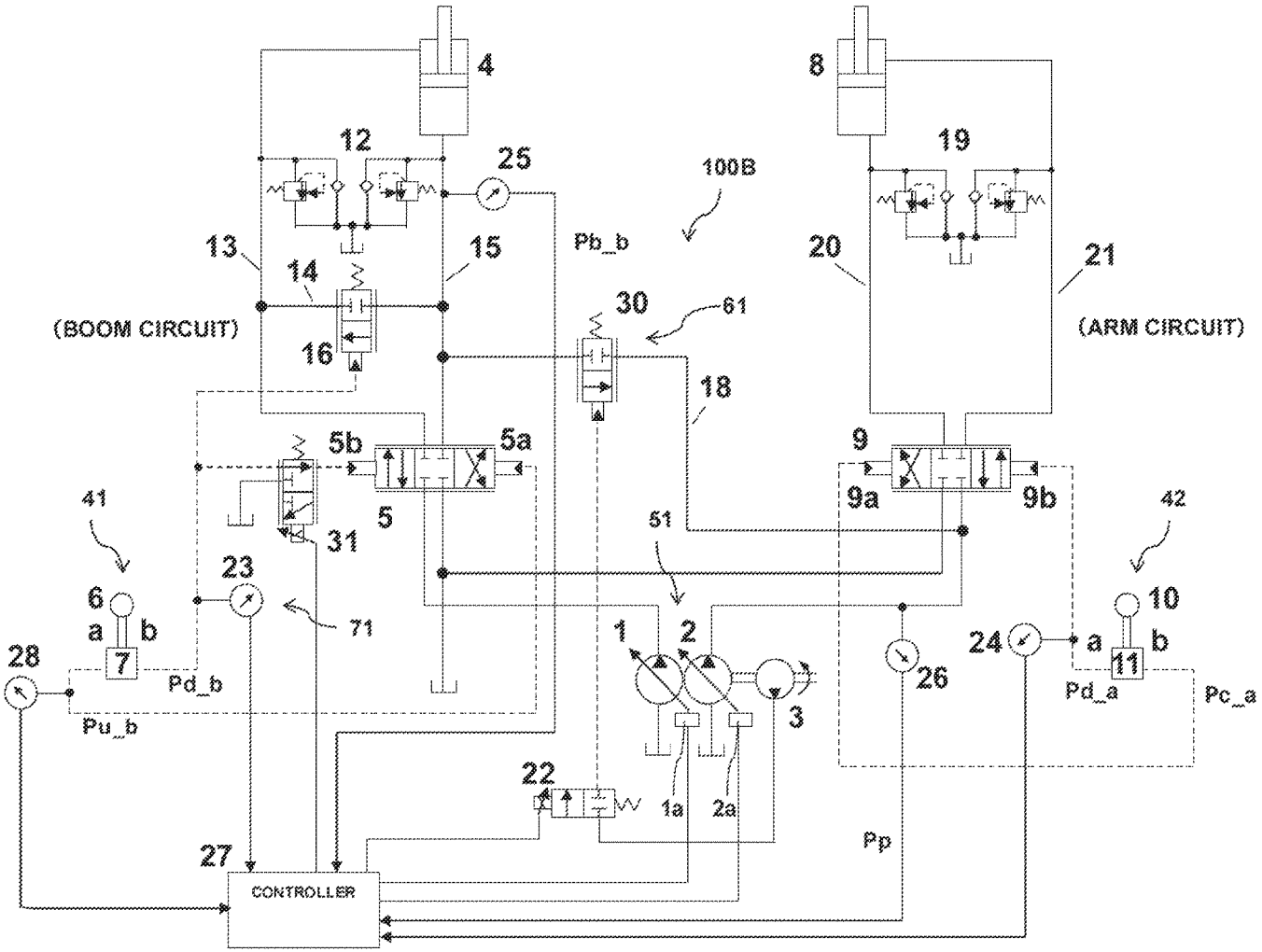
FIG. 7 is a configuration diagram of a hydraulic drive system according to Embodiment 2 of the invention.

We now describe the structure of a hydraulic drive system 100B with reference to FIG. 7. FIG. 7 is a configuration diagram of the hydraulic drive system 100B of Embodiment 2 of the invention. The same components as those used in Embodiment 1 will not be discussed further in detail.

Referring to FIG. 7, in Embodiment 2, the regeneration control valve 17 of Embodiment 1 that has ports leading to the control valve 5 and the regenerative-side line 18 is replaced by a regeneration control valve 30 that adjusts only the flow rate of the regenerative-side line 18. In addition, a solenoid proportional valve 31 of a normally-open type for reducing the lowering side pilot pressure Pd_b of the pilot valve 7 is provided. The solenoid valve 31 is controlled by the controller 27.

The regenerative-side line 18 (regenerative passage), the regeneration control valve 30 (regenerative valve), the solenoid proportional valve 22 (first solenoid valve), and the solenoid proportional valve 31 (second solenoid valve) constitute the regenerative device 61. The regenerative-side line 18 supplies the retuning fluid from the boom cylinder 4 (first hydraulic actuator) to the arm cylinder 8 (second hydraulic actuator). The regeneration control valve 30 adjusts the flow rate of the hydraulic fluid in the regenerative-side line 18. The solenoid proportional valve 22 performs hydraulic control on the regeneration control valve 30. The solenoid proportional valve 31 of the normally-open proportional type receives a first pilot pressure corresponding to the operation amount of the first operation device 41 and outputs to the control valve 5 a second pilot pressure which is obtained by reducing the first pilot pressure, thereby controlling the control valve 5 based on the second pilot pressure.

We next describe a case where a boom lowering operation and an arm drive operation are performed at the same time.

The pilot pressure Pd_a generated at the pilot valve 11 is input to the operation port 9*b* of the control valve 9. As a result, the control valve 9 is switched, allowing the bottom-side line 20 to communicate with the tank and the rod-side line 21 to communicate with the hydraulic pump 2. The hydraulic fluid of the bottom is discharged to the tank, and the hydraulic fluid of the hydraulic pump 2 flows to the rod side, whereby the arm cylinder 8 contracts.

The controller 27 receives signals from the pressure sensors 23, 24, 25, 26, and 28 and outputs signals to the solenoid proportional valves 22 and 31 based on the later-described control logic. The regeneration control valve 30 (regenerative valve) is controlled by the pressure signal from the solenoid proportional valve 22, whereby the bottom hydraulic fluid of the boom cylinder 4 is regenerated to the arm cylinder 8 via the regeneration control valve 30. The pilot pressure Pd_b is reduced by the solenoid proportional valve 31 in an appropriate manner, and throttle adjustment is made for the control valve 5.

When the sensor device 71 is normal and the values measured by the sensor device 71 satisfy the regenerative conditions, the controller 27 act as a third control part that controls the solenoid proportional valve 31 (second solenoid valve) such that the first pilot pressure is reduced. When the sensor device 71 is abnormal, the controller 27 (third control part) controls the solenoid proportional valve 31 such that the first pilot pressure is not reduced even if the values measured by the sensor device 71 satisfy the regenerative conditions.

Thus, the bleed flow rate discharged to the tank is reduced by the flow rate regenerated via the regeneration control valve 30, and speed adjustment is made such that the boom cylinder 4 has the speed desired by the operator.

In addition, the above structure allows finer control of the regeneration flow rate and the bleed flow rate and less fuel consumption than in Embodiment 1 since the regeneration control valve 30 and the control valve 5 can be controlled separately.

Further, since the pilot pressure Pd_b generated from the pilot valve 7 is input to the communication control valve 16, the hydraulic fluid discharged from the bottom of the boom cylinder 4 is regenerated, and the hydraulic fluid of the hydraulic pump 1 flows to the rod-side line 13 of the boom cylinder so that it does not have a negative pressure.

Furthermore, the controller 27 outputs a tilting command to the hydraulic pump 2 and reduces the pump flow rate based on the regeneration flow rate of the regeneration control valve 30 to reduce fuel consumption.

<Control Logic>

Figure 8A:
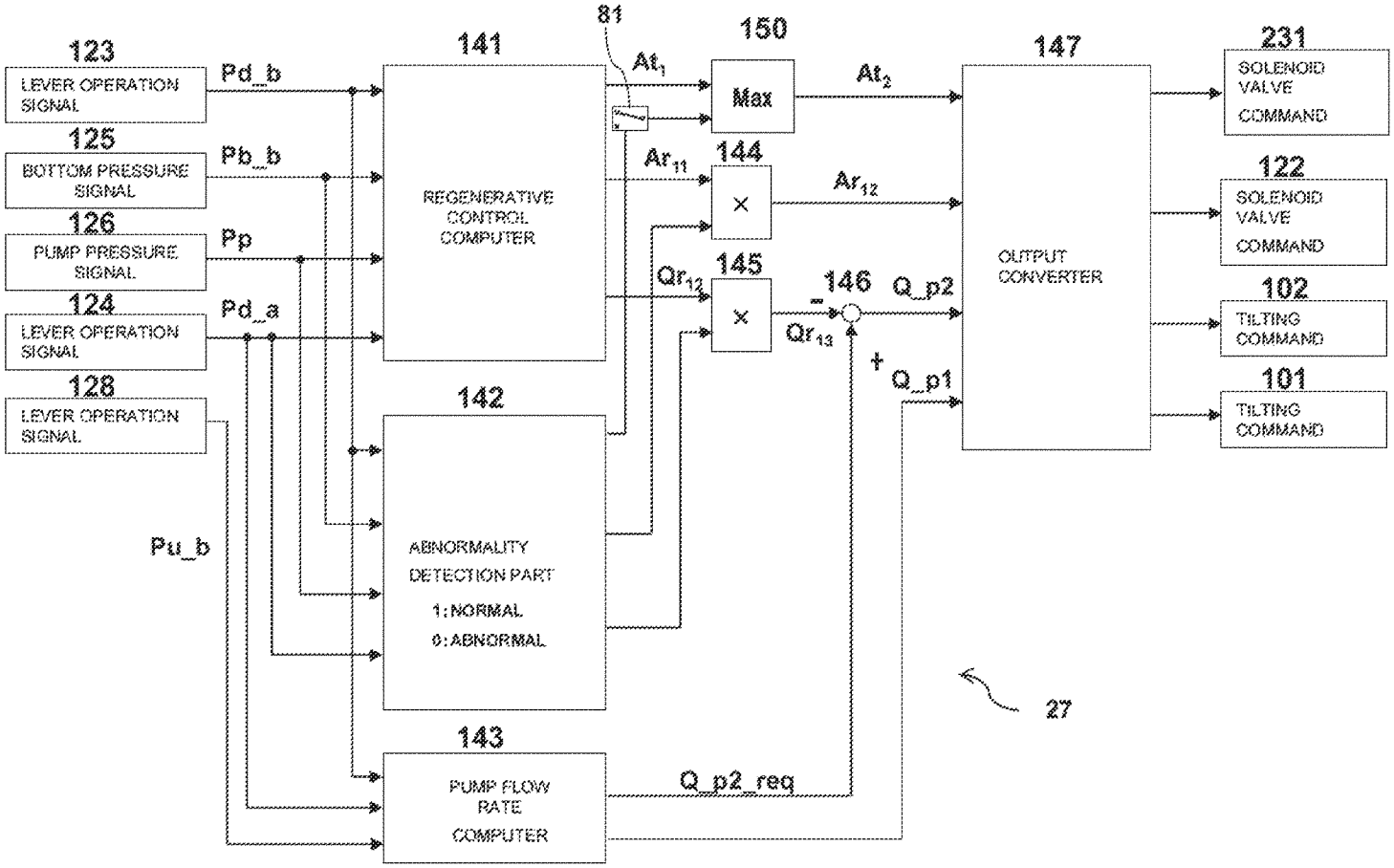
FIG. 8A is a diagram illustrating the control logic of the controller of FIG. 7.
Figure 8B:
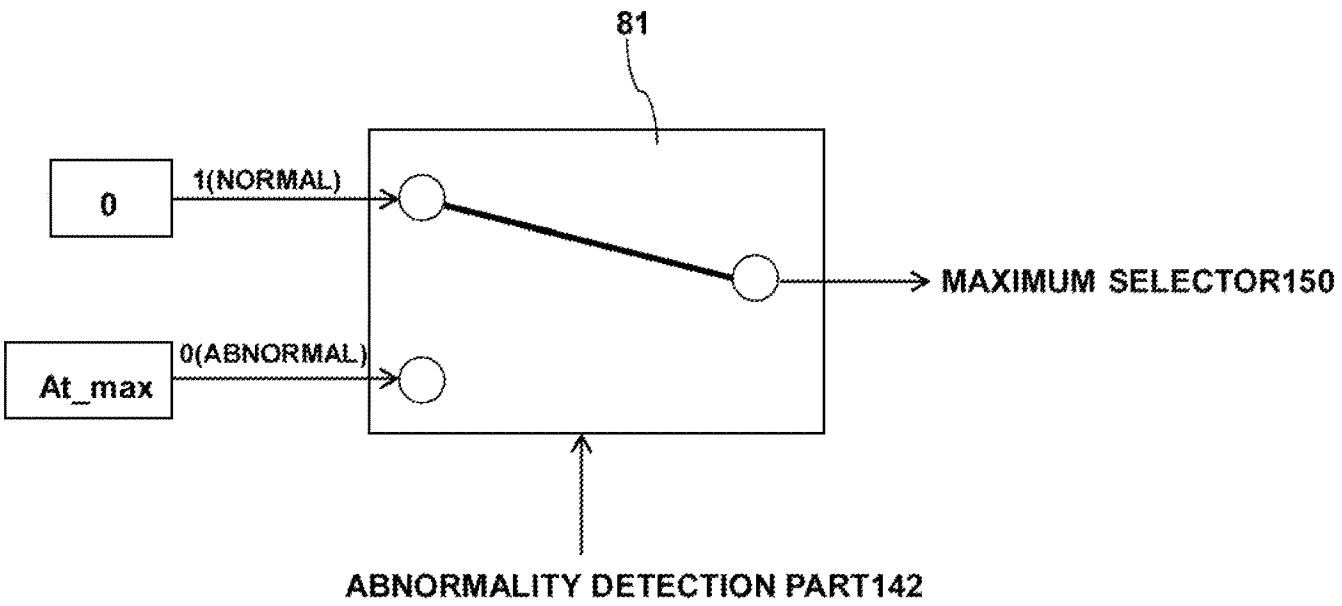
FIG. 8B is a diagram illustrating the selector switch of FIG. 8A.

We next describe the control logic used for a computation in the controller 27 with reference to FIG. 8. FIG. 8A is a diagram illustrating the control logic of the controller 27 of FIG. 7. FIG. 8B is a schematic diagram illustrating the selector switch 81 of FIG. 8A.

As illustrated in FIG. BA, unlike Embodiment 1, the regenerative control computer 141 outputs a target tank-side opening area $At_1$ (the uppermost signal) in addition to a target regenerative-side opening area $Ar_{11}$ and a target reduced pump flow rate $Qr_{12}$ supplied to the integrators 144 and 145, respectively.

In Embodiment 2, the target regenerative-side opening area $Ar_{11}$ and the target reduced pump flow rate $Qr_{12}$ are computed by a different method, which is described below together with the computation method for the target tank-side opening area $At_1$.

Figure 9:
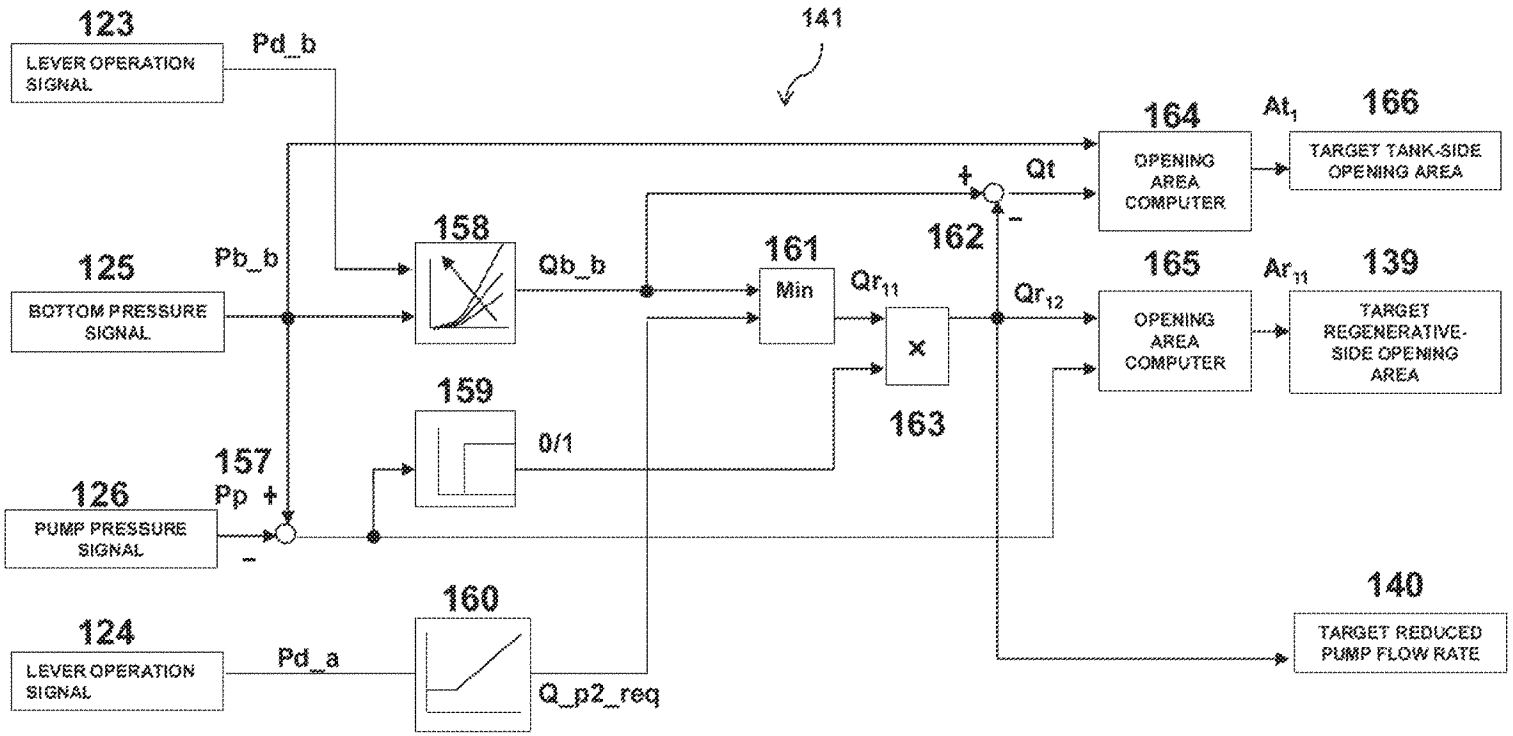
FIG. 9 is a configuration diagram of the regenerative control computer of FIG. 8A.

FIG. 9 is a configuration diagram of the regenerative control computer 141 of FIG. 8A. As illustrated in FIG. 9, a function generator 158 receives the lever operation signal 123 (value: Pd_b) and the bottom pressure signal 125 (value: Pb_b) to determine a target bottom flow rate Qb_b. The target bottom flow rate Qb_b has a characteristic such as to increase in proportion to the lever operation signal 123, and to get steeper as the pressure (Pb_b) increases.

The output of the lever operation signal 124 (value: Pd_a) is input to the function generator 160 to compute the demanded flow rate Q_p2_req of the hydraulic pump 2. That is, the function generator 160 has the same characteristics as that of the function generator 151 of Embodiment 1 illustrated in FIG. 6.

A minimum selector 161 receives the target bottom flow rate Qb_b output from the function generator 158 and the demanded flow rate Q_p2_req of the hydraulic pump 2 output from the function generator 160 and determines the smaller of the two as a target regeneration flow rate $Qr_{11}$. The reason for selecting the smaller of the target bottom flow rate Qb_b and the demanded flow rate Q_p2_req of the hydraulic pump 2 is that if the regeneration flow rate becomes larger than the flow rate of the hydraulic pump 2 that is originally intended, the arm cylinder 8 moves faster than when it is driven by a typical hydraulic pump 2, which deteriorates operability.

A subtractor 157 computes the differential pressure between the bottom pressure Pb_b indicated by the bottom pressure signal 125 and the pump pressure Pp indicated by the pump pressure signal 126 and supplies the differential pressure to an output determining unit 159.

The output determining unit 159 (function generator) receives the differential pressure that is based on the bottom pressure signal 125 and the pump pressure signal 126.

The output determining unit 159 outputs 1 when the differential pressure exceeds a set value and 0 when the differential pressure is equal to or less than the set value.

In other words, the output determining unit 159 outputs, to an integrator 163, 1 when the bottom pressure signal 125 (value: Pb_b) is higher than the pump pressure signal 126 (value: Pp) and 0 when the pump pressure signal 126 is higher.

The integrator 163 receives the target regeneration flow rate $Qr_{11}$ and the output (0 or 1) of the output determining unit 159 and outputs the target regeneration flow rate $Qr_{11}$ when the bottom pressure Pb_b is higher and 0 when the pump pressure Pp is higher. With the above computation, when the pump pressure Pp is higher and regeneration is impossible, a 0 signal is output to issue a command not to operate it.

An opening area computer 165 receives the target regeneration flow rate $Qr_{12}$ computed by the integrator 163 and the differential pressure (Pb_b−Pp) which is based on the bottom pressure signal 125 (value: Pb_b) and the pump pressure signal 126 (value: Pp), and the target regenerative-side opening area 139 (value: $Ar_{11}$) of the regeneration control valve 30 is calculated from orifice formula (1). If the target regeneration flow rate, the bottom pressure signal 125 of the boom cylinder 4, and the pump pressure signal 126 are represented by Qr, Pb_b, and Pp, respectively, Ar, which is the target regenerative-side opening area 139 of the regeneration control valve 30, is calculated as follows:

$$Ar=Qr/(C\sqrt{(Pb_b-Pp)}) \quad (1)$$

where C is the flow rate coefficient.

The subtractor 162 receives the target regeneration flow rate $Qr_{12}$ computed by the integrator 163 and the target bottom flow rate Qb_b to compute a target discharge flow rate Qt (=Qb_b−$Qr_{12}$). The target discharge flow rate Qt and the bottom pressure signal 125 (value: Pb_b) are input to an opening area computer 164 to compute a target tank-side opening area 166 (value: $At_1$) from the following orifice formula (2).

$$At=Qt/(C\sqrt{(Pb_b)}) \quad (2),$$

where Qt is the target discharge flow rate and At is the target tank-side opening area 166 output to the solenoid proportional valve 31.

The target regeneration flow rate $Qr_{12}$ output from the integrator 163 is output as the target reduced pump flow rate 140.

The controller 27 (second control part) selects, as a minimum value $Qr_{31}$, the smaller of the target bottom flow rate Qb_b indicative of the flow rate of the hydraulic fluid to be discharged from the bottom side of the boom cylinder 4 based on the operation amount Pd_b of the first operation device 41 and the hydraulic pressure Pb_b of the bottom side of the boom cylinder 4 (first hydraulic actuator) and the demanded flow rate Q_p2_req of the pump indicative of the flow rate of the hydraulic fluid to be supplied to the arm cylinder 8 based on the operation amount Pd_a of the second operation device 42 and outputs the regeneration flow rate $Qr_2$ based on the minimum value $Qr_{11}$.

Thus, the regenerative control computer 141 outputs the target tank-side opening area 166 (value: $At_1$), the target regenerative-side opening area 139 (value: $Ar_{11}$), and the target reduced pump flow rate 140 (value: $Qr_{12}$).

As illustrated in FIG. 8A, in Embodiment 2, the selector switch 81 and a maximum selector 150 are added. The maximum selector 150 receives the target tank-side opening area $At_1$ output from the regenerative control computer 141 and the output value of the selector switch 81. As illustrated in FIG. 8B, the selector switch 81 outputs 0 to the maximum selector 150 when it receives 1 (normal) from the abnormality detection part 142. On the other hand, the selector switch 81 outputs a maximum opening area At_max of the control valve 5 to the maximum selector 150 when it receives 0 (abnormal) from the abnormality detection part 142.

Thus, when the abnormality detection part 142 detects an abnormality, the maximum opening area At_max is always output from the maximum selector 150 regardless of the output $At_1$ of the regenerative control computer 141.

Conversely, when the abnormality detection part 142 detects that it is normal, the value $At_1$ computed at the regenerative control computer 141 is output to the maximum selector 150 as it is.

Referring to FIG. 7, since the solenoid proportional valve 31 is a solenoid proportional valve of a normally-open type, the lowering pilot pressure Pd_b is not reduced by the solenoid proportional valve 31 but a pressure signal thereof is applied as it is to the control valve 5 when a solenoid valve command 231 is 0, that is, an electric current is 0. Conversely, when the solenoid valve command 231 is increased, that is, the electric current is increased, the lowering pilot pressure Pd_b is reduced by the solenoid proportional valve 31, thereby reducing the opening degree of the control valve 5.

Described next is operation.

As illustrated in FIG. 9, the regenerative control computer 141 computes the target tank-side opening area $At_1$, the target regenerative-side opening area $Ar_{11}$, and the target reduced pump flow rate $Qr_{12}$ on the basis of various signals including the lever operation signal 123, the bottom pressure signal 125, the pump pressure signal 126, and the lever operation signal 124.

The target regenerative-side opening area $Ar_1$ is controlled and adjusted such that the hydraulic fluid discharged from the boom cylinder 4 is regenerated as much as possible to the hydraulic pump 2 and such that the flow rate of the hydraulic fluid flowing into the arm cylinder 8 does not exceed the flow rate when regeneration is not performed.

The target tank-side opening area $At_1$ is controlled and adjusted such that the flow rate of the hydraulic fluid discharged from the boom cylinder 4 stays the same regardless of whether regeneration is performed or not.

Further, the computed regeneration flow rate $Qr_{12}$ is output as the target reduced pump flow rate to reduce the flow rate of the hydraulic pump 2 by the value of the regeneration flow rate.

As illustrated in FIG. 8A, each output via the integrators 144 and 145, the selector switch 81, the maximum selector 150, and the subtractor 146 is converted at the output converter 147. A target tank-side opening area $At_2$ is output as the solenoid valve command 231, a target regenerative-side opening area Ar12 being output as the solenoid valve command 122, the target flow rate Q_p2 of the hydraulic pump 2 being output as the tilting command 102, the target flow rate Q_p1 of the hydraulic pump 1 being output as the tilting command 101.

When the abnormality detection part 142 detects that it is normal, it outputs 1 to the integrators 144 and 145 and the selector switch 81, thereby allowing the target tank-side opening area $At_1$, target regenerative-side opening area $Ar_{11}$, and target reduced pump flow rate $Qr_{12}$ computed by the regenerative control computer 141 to be output as they are. As a result, the regeneration control valve 30 is controlled and adjusted by the solenoid proportional valve 22, and the control valve 5 is controlled and adjusted by the solenoid proportional valve 31. Also, the hydraulic fluid discharged from the boom cylinder 4 is regenerated as much as possible to the hydraulic pump 2, and the control valve 5 is controlled to maintain the speed of the boom cylinder 4.

The subtractor 146 subtracts the target flow rate of the hydraulic pump 2, that is, the regeneration flow rate $Qr_{13}$, from the demanded flow rate Q_p2_req of the hydraulic pump 2. Thus, the flow rate of the hydraulic pump 2 is reduced by the value of the regeneration flow rate, leading to less fuel consumption.

If the abnormality detection part 142 detects an abnormality, the selector switch 81 outputs the maximum opening area At_max to the maximum selector 150. Thus, the lowering pilot pressure Pd_b input to the solenoid proportional valve 31 is not reduced but applied to the control valve 5 as it is, whereby it is adjusted to have the opening area corresponding to the operation amount of the operation lever 6.

Also, computation is performed such that based on the output from the abnormality detection part 142, the target regenerative-side opening area 139 (value: $Ar_{12}$) and the target reduced pump flow rate 140 (value: $Qr_{13}$) are set to 0. As a result, the regeneration control valve 30 is kept closed, and all the hydraulic fluid discharged from the boom cylinder 4 is directed to the tank via the control valve 5. Since the control valve 5 has the opening area that corresponds to the operation of the operation lever 6, the boom cylinder 4 is adjusted to have the speed desired by the operator.

Further, the flow rate of the hydraulic pump 2 becomes the flow rate corresponding to the operation amount of the operation lever 10, and the arm cylinder is adjusted to have the speed desired by the operator.

As described above, according to Embodiment 2 of the invention, the hydraulic fluid discharged from the boom cylinder 4 is finely controlled and adjusted by the control valve 5 via the regeneration control valve 30 and the solenoid proportional valve 31. Therefore, more hydraulic fluid is regenerated and thus regenerated than in Embodiment 1, and the speed of the boom cylinder 4 can be maintained at the speed desired by the operator. In addition, by reducing the flow rate of the hydraulic pump 2 by the value of the regeneration flow rate, the arm cylinder is adjusted to have the arm speed desired by the operator, leading to less fuel consumption.

Moreover, similar to Embodiment 1, the actuators are adjusted to have the speeds desired by the operator irrespective of whether the sensors are normal or abnormal.

As described above, according to the present embodiment, it is possible to ensure that the operation of the hydraulic actuators (boom cylinder 4 and arm cylinder 8) matches the operator's operation even if an abnormality occurs in the sensor device 71.

Embodiment 3

Figure 10:
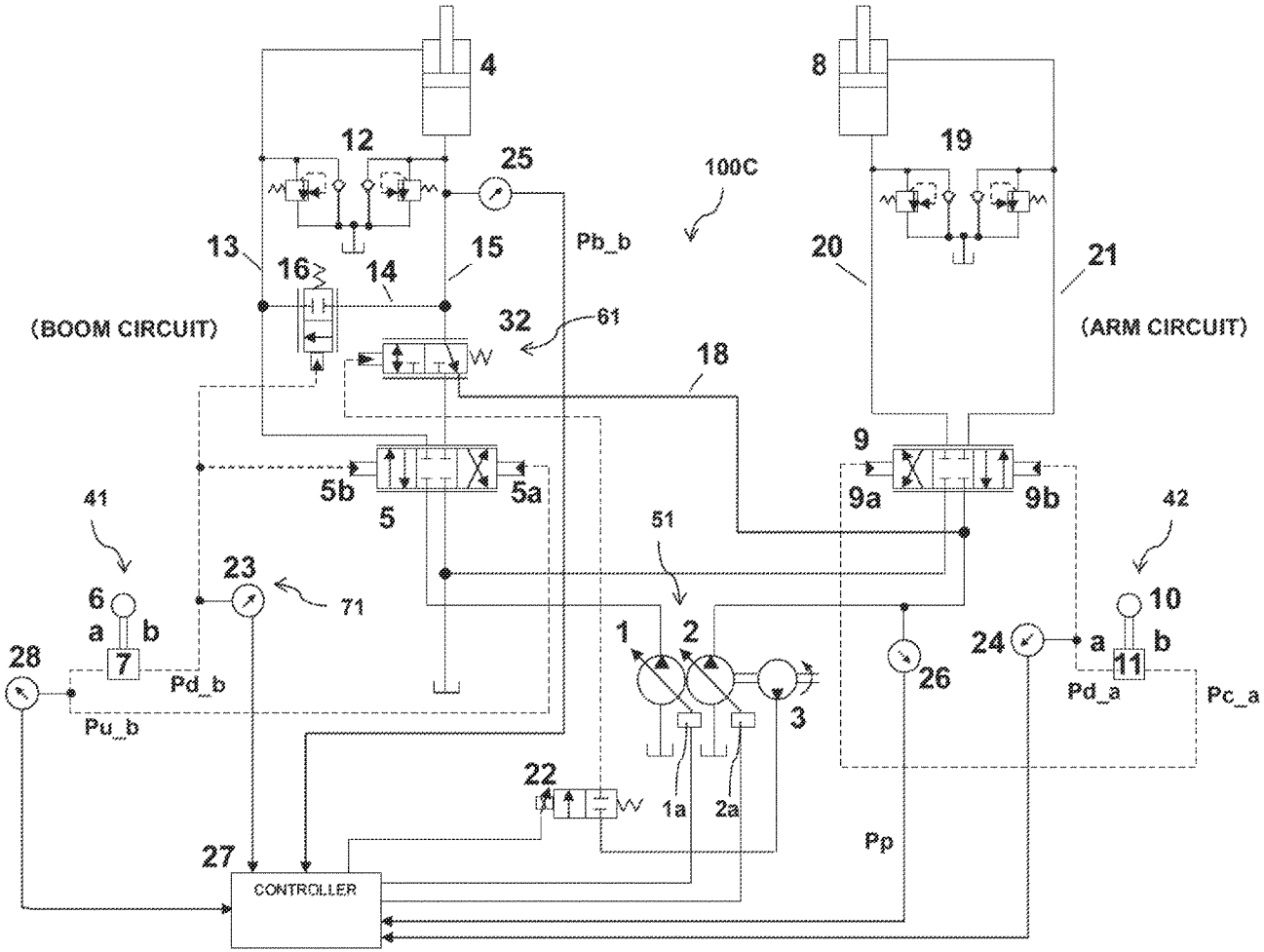
FIG. 10 is a configuration diagram of a hydraulic drive system according to Embodiment 3 of the invention.

We now describe the structure of a hydraulic drive system 100C with reference to FIG. 10. FIG. 10 is a configuration diagram of the hydraulic drive system 100C of Embodiment 3 of the invention. The same components as those used in Embodiment 1 will not be discussed further in detail.

As illustrated in FIG. 10, while the regeneration control valve 17 of Embodiment 1 is normally closed on the regenerative side, the regeneration control valve 32 of Embodiment 3 is normally opened on the regenerative side.

In Embodiment 3, the controller 27 performs control such that at the time of a normal boom-lowering operation in which the hydraulic fluid of the boom cylinder 4 is not regenerated to the arm cylinder 8, the output of the solenoid proportional valve 22 is sent to the regeneration control valve 32 to switch it, thereby directing the hydraulic fluid discharged from the bottom of the boom cylinder 4 to the control valve 5 and not regenerating the hydraulic fluid to the arm cylinder 8.

Further, the controller 27 performs control such that at the time of a boom-lowering arm-dumping operation, the output of the solenoid proportional valve 22 is prevented from increasing and such that the hydraulic fluid discharged from the boom cylinder 4 is regenerated to the arm cylinder 8 via the regeneration control valve 32.

The regenerative-side line 18 (regenerative passage), the regeneration control valve 32 (regenerative valve), and the solenoid proportional valve 31 (second solenoid valve) constitute the regenerative device 61.

<Control Logic>

Figure 11:
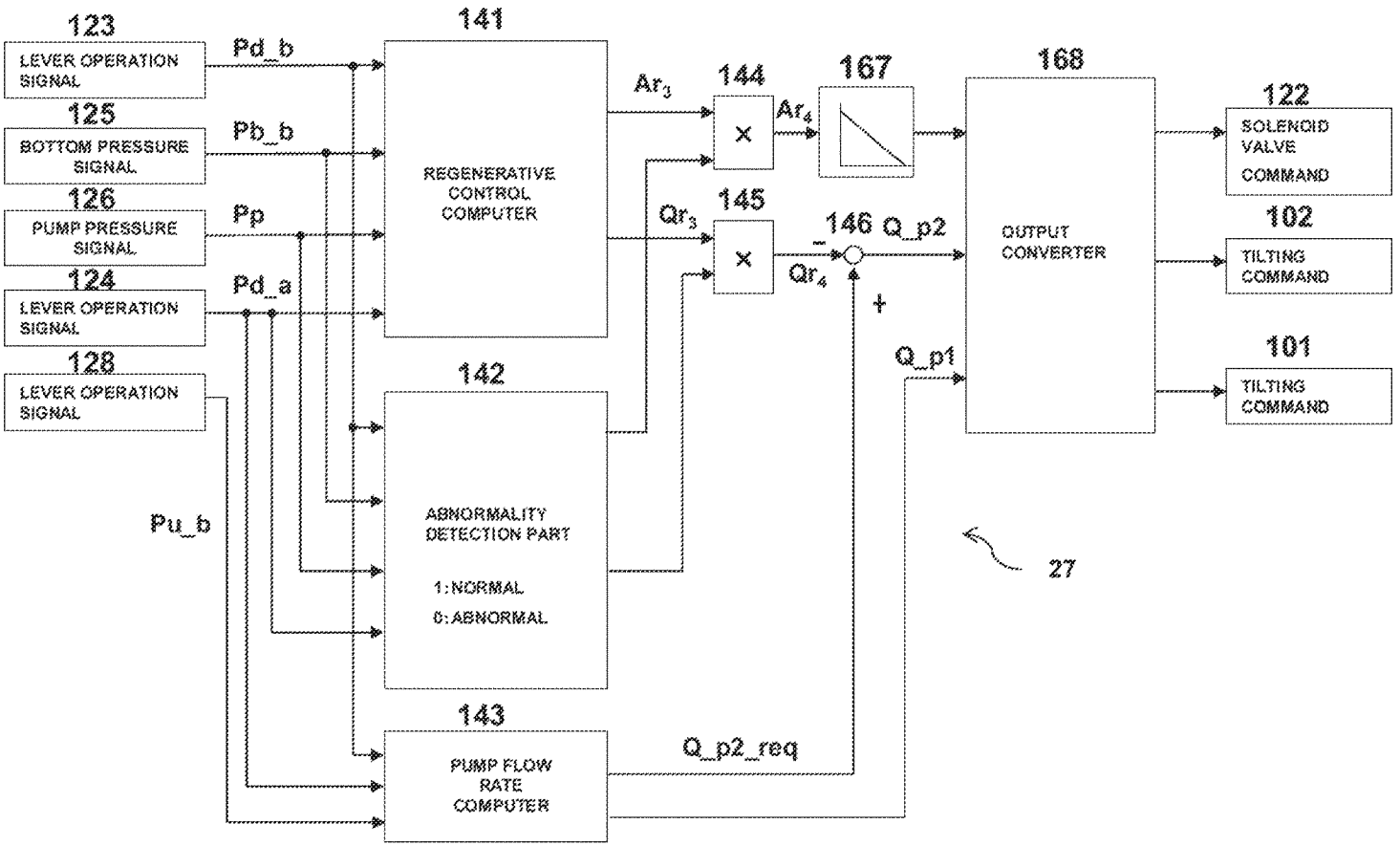
FIG. 11 is a diagram illustrating the control logic of the controller of FIG. 10.

We next describe the control logic used in the controller 27 with reference to FIG. 11. FIG. 11 illustrates the control logic of the controller 27 of FIG. 10. The same components as those used in Embodiment 1 illustrated in FIG. 2 will not be discussed further in detail.

As illustrated in FIG. 11, a function generator 167 is added, which is a difference from Embodiment 1.

The function generator 167 receives via the integrator 144 the target regenerative-side opening area 139 (value: $Ar_3$) computed at the regenerative control computer 141.

The function generator 167 is based on the relation between the regenerative-side opening area $Ar_4$ of the regeneration control valve 32 and the control pressure output from the solenoid proportional valve 22. That is, the function generator 167 has the characteristics that when the regenerative-side opening area of the regeneration control valve 32 is closed, a maximum control pressure is output to switch the regeneration control valve 32 and that when the regenerative-side opening area is fully opened, a minimum control pressure is output so as not to switch the regeneration control valve 32.

An output converter 168 outputs the solenoid valve command 122 to the solenoid proportional valve 22 such that the control pressure output from the function generator 167 is achieved.

Described next is operation.

When the regenerative control computer 141 receives the lever operation signal 123, the bottom pressure signal 125, the pump pressure signal 126, and the lever operation signal 124, it outputs the target regenerative-side opening area 139 if all the regenerative conditions are met.

The abnormality detection part 142 determines whether the sensor signals are normal or abnormal; it outputs 1 when they are normal and 0 when they are abnormal to the integrator 144.

Thus, when any sensor is abnormal, the target regenerative-side opening area is set to 0.

The function generator 167 receives the target regenerative-side opening area output from the integrator 144 and outputs a control pressure that adjusts the regenerative-side opening area of the regeneration control valve 32 to the desired value.

The output converter 168 outputs the solenoid valve command 122 to the solenoid proportional valve 22 such that the control pressure output from the function generator 167 is achieved.

From above, when the abnormality detection part 142 determines that all the sensors are normal, a control pressure for achieving the target regenerative-side opening area 139 is output as it is, and the regeneration control valve is adjusted to have the desired opening area. The regeneration control valve 17 controls and adjusts the hydraulic fluid discharged from the boom cylinder 4 and regenerates it to the hydraulic pump 2 via the regenerative-side line 18.

When the abnormality detection part 142 determines that any sensor is abnormal, the abnormality detection part 142 performs computation such that the target regenerative-side opening area 139 is set to 0, thereby allowing the function generator 167 to output the maximum control pressure. As a result, the regeneration control valve 17 is switched, speed adjustment is made based on the opening area of the control valve 5 that changes in response to the operation lever 6, and the speed desired by the operator is achieved.

As described above, according to the present embodiment, it is possible to ensure that the operation of the hydraulic actuators (boom cylinder 4 and arm cylinder 8) matches the operator's operation even when an abnormality occurs in the sensor device 71.

The present invention is not limited to the embodiments described above but allows various modifications. The above embodiments are presented merely for illustrative purposes, and the invention is not limited to a system that has all the components described above. Some components of an embodiment can be replaced by some components of another, and some components of an embodiment can be added to another embodiment. Each of the embodiments allows addition, removal, or replacement of some components.

In the foregoing embodiments, while the pressure sensor 26 is provided at the exit of a hydraulic pump, it can instead be provided on the rod side of the arm cylinder 8. The pressure sensor 26 only needs to measure the pressure between the hydraulic pump 2 and the arm cylinder 8.

In the foregoing embodiments, while the number of hydraulic pumps that constitute the hydraulic pump device 51 is two, the invention is not limited thereto. The number can also be one. When a single hydraulic pump constitutes the hydraulic pump device 51, the controller 27 (second control part) controls the hydraulic pump such that the delivery flow rate of the hydraulic pump is reduced based on the regeneration flow rate if the sensor device 71 is normal and the values measured by the sensor device 71 satisfy the regenerative conditions. In that case, although the flow rate of the hydraulic fluid supplied from the hydraulic pump to the rod side 13 of the boom cylinder 4 is also reduced, the supply from the hydraulic pump is hardly necessary, and operability does not be affected if the opening degree of the communication control valve 16 is increased to ensure that a sufficient flow rate from the bottom to rod of the boom cylinder 4.

In the foregoing embodiments, the pressure sensor 23 or 28 is used to measure the operation amount of the operation lever 6. However, the invention is not limited thereto. The sensors 23 and 28 can instead be resistance-type position sensors. The same applies to the operation amount of the operation lever 10.

In the foregoing embodiments, the first operation amount sensor (23 or 28), the second operation amount sensor (24), the first pressure sensor (25), and the second pressure sensor (26) are pressure sensors that output electric signals that match measured pressures. However, the type of the pressure sensors is not limited thereto. For example, the pressure sensors can measure hydraulic pressures using hydraulic logic.

In the foregoing embodiments, we have described cases where the invention is applied to a hydraulic excavator. However, the invention can also be applied to a hydraulic crane, a wheel loader, or other work machine as long as it has a hydraulic cylinder that discharges hydraulic fluid from the bottom side of and absorbs it from the rod side by the boom (first driven component) falling under its own weight when the first operation device 41 is operated in a self-weight falling direction of the boom.

In the foregoing embodiments, we have described cases where the hydraulic fluid discharged from the bottom side of the boom cylinder 4 (first hydraulic actuator) is regenerated to the arm cylinder 8 (second hydraulic actuator) by the boom 205 falling under its own weight. However, the hydraulic fluid can also be regenerated to the travel motors 201*c* and 201*d*, the swing motor 202*a*, and other hydraulic cylinders. It is also possible to regenerate the hydraulic fluid discharged from the travel motors 201*c* and 201*d* or the swing motor 202*a* by inertial force to other hydraulic cylinders.

In the foregoing embodiments, the hydraulic fluid of the hydraulic pump 1 flows to the rod-side line 13 at the time of a boom lowering operation. However, the hydraulic fluid can instead be prevented from flowing thereto by closing the meter-in part of the control valve 5.

The above-described components and functions can be implemented partially or completely by hardware, for example, an integrated circuit. The above-described components and functions can also be implemented by software, in which case a processor interprets and executes the programs that implement the functions. The information on the programs, tables, flies, and the like that are used to implement the functions can be stored on a storage device such as a memory, hard disk, and SSD (solid state drive) or on recording medium such as an IC card, SD card, and DVD.

DESCRIPTION OF THE REFERENCE CHARACTERS

1: Hydraulic pump (hydraulic pump device)
2: Hydraulic pump (hydraulic pump device)

4: Boom cylinder (first hydraulic actuator)
5: Control valve
6: Operation lever (first operation device)
7: Pilot valve (first operation device)
8: Arm cylinder (second hydraulic actuator)
10: Operation lever (second operation device)
11: Pilot valve (second operation device)
17: Regeneration control valve (regenerative valve)
18: Regenerative-side line (regenerative passage, regenerative device)
22: Solenoid proportional valve (first solenoid valve, regenerative device)
23: Pressure sensor (first operation amount sensor)
24: Pressure sensor (second operation amount sensor)
25: Pressure sensor (first pressure sensor)
26: Pressure sensor (second pressure sensor)
27: Controller (controller, first control part, second control part, third control part)
28: Pressure sensor (first operation amount sensor)
30: Regeneration control valve (regenerative valve, regenerative device)
31: Solenoid proportional valve (second solenoid valve, regenerative device)
32: Regeneration control valve (regenerative device)
41: First operation device
42: Second operation device
51: Hydraulic pump device
61: Regenerative device
71: Sensor device
100A, 100B, 100C: Hydraulic drive system for work machine
142: Abnormality detection part

The invention claimed is:

1. A hydraulic drive system for a work machine, the system comprising:

a boom cylinder;

an arm cylinder;

a hydraulic pump device configured to supply hydraulic fluid to the boom cylinder and the arm cylinder;

a control valve configured to adjust a flow rate of the hydraulic fluid returning from the boom cylinder;

a regenerative device configured to supply the hydraulic fluid returning from a bottom side of the boom cylinder to the arm cylinder;

a first operation device configured to operate the boom cylinder;

a second operation device configured to operate the arm cylinder;

a sensor device including at least one of a first operation amount sensor configured to measure an operation amount of the first operation device, a second operation amount sensor configured to measure an operation amount of the second operation device, a first pressure sensor configured to measure a pressure of the bottom side of the boom cylinder, and a second pressure sensor configured to measure a pressure between the hydraulic pump device and the arm cylinder; and a controller configured to determine whether the sensors included in the sensor device are abnormal or not and control the regenerative device such that the hydraulic fluid returning from the bottom side of the boom cylinder is supplied to the arm cylinder when the sensors are all determined to be normal and values measured by the sensors satisfy regenerative conditions that are required to be met when the hydraulic fluid returning from the bottom side of the boom cylinder is supplied to the arm cylinder and such that, when any one of the sensors is determined to be abnormal, the hydraulic fluid returning from the bottom side of the boom cylinder is not supplied to the arm cylinder even if the values measured by the sensor device satisfy the regenerative conditions.

2. The hydraulic drive system for a work machine according to claim 1, wherein the controller is further configured to control the hydraulic pump device such that when the sensors are all determined to be normal and the values measured by the sensors satisfy the regenerative conditions, the delivery flow rate of the hydraulic pump device is reduced on the basis of a regeneration flow rate at which the hydraulic fluid returning from the bottom side of the boom cylinder is supplied to the arm cylinder and, when the any one of the sensors is determined to be abnormal, cancels the control for reducing the delivery flow rate of the hydraulic pump device even if the values measured by the sensors satisfy the regenerative conditions.

3. The hydraulic drive system for a work machine according to claim 1, wherein the regenerative device is a directional control valve having a port through which the hydraulic fluid returning from the bottom side of the boom cylinder is supplied to the arm cylinder and a port through which the hydraulic fluid returning from the bottom side of the boom cylinder is discharged to the control valve.

4. The hydraulic drive system for a work machine according to claim 1, wherein the regenerative device includes:

a regenerative passage for supplying the hydraulic fluid returning from the bottom side of the boom cylinder to the arm cylinder;

a regenerative valve configured to adjust the flow rate of the hydraulic fluid in the regenerative passage;

a first solenoid valve configured to control the regenerative valve hydraulically; and a second solenoid valve of a normally-open type configured to receive a first pilot pressure corresponding to the operation amount of the first operation device and output to the control valve a second pilot pressure which is obtained by reducing the first pilot pressure for controlling the control valve with the second pilot pressure and wherein the controller is further configured to control the second solenoid valve such that when the sensors are all determined to be normal and the values measured by the sensors satisfy the regenerative conditions, the first pilot pressure is reduced and such that when the any one of the sensors is determined to be abnormal, the first pilot pressure is not reduced even if the values measured by the sensors satisfy the regenerative conditions.

5. The hydraulic drive system for a work machine according to claim 1, wherein the first operation amount sensor, the second operation amount sensor, the first pressure sensor, and the second pressure sensor included in the sensor device are pressure sensors that output electric signals that match measured pressures and wherein the controller is configured to determine the presence of an abnormality when any of the electric signals output by the pressure sensors becomes lower than a predetermined lower limit value or higher than a predetermined upper limit value.

* * * * *